US007036242B2

(12) United States Patent
Komulainen et al.

(10) Patent No.: US 7,036,242 B2
(45) Date of Patent: May 2, 2006

(54) IMPINGEMENT DRYING UNIT AND A DRYER SECTION

(75) Inventors: Antti Komulainen, Keuruu (FI); Matti Kurki, Jyväskylä (FI); Martti Salminen, Jyväskylä (FI); Kari Juppi, Palokka (FI); Juha Kaihovirta, Jyväskylä (FI); Antti Kuhasalo, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 224 days.

(21) Appl. No.: 10/415,863

(22) PCT Filed: Nov. 6, 2001

(86) PCT No.: PCT/FI01/00963

§ 371 (c)(1),
(2), (4) Date: Sep. 29, 2003

(87) PCT Pub. No.: WO02/36880

PCT Pub. Date: May 10, 2002

(65) Prior Publication Data

US 2004/0049940 A1 Mar. 18, 2004

(30) Foreign Application Priority Data

Nov. 6, 2000 (FI) ..... 20002429

(51) Int. Cl.
*F26B 3/00* (2006.01)

(52) U.S. Cl. ..... 34/117

(58) Field of Classification Search ..... 34/114, 34/115, 117, 119, 120; 162/358.1, 359.1
See application file for complete search history.

(56) References Cited

U.S. PATENT DOCUMENTS

| | | | | |
|---|---|---|---|---|
| 5,865,955 | A * | 2/1999 | Ilvespaa et al. | 162/207 |
| 5,950,329 | A | 9/1999 | Lehtinen et al. | |
| 6,003,241 | A * | 12/1999 | Komulainen et al. | 34/117 |
| 6,237,248 | B1 | 5/2001 | Mayer | |
| 6,294,050 | B1 * | 9/2001 | Oechsle et al. | 162/207 |
| 6,372,094 | B1 | 4/2002 | Heikkilä et al. | |
| 6,413,371 | B1 | 7/2002 | Ahonen et al. | |
| 6,910,282 | B1 * | 6/2005 | Kokinen et al. | 34/444 |

FOREIGN PATENT DOCUMENTS

DE 36 15 152 A1 11/1987

(Continued)

OTHER PUBLICATIONS

Search Report issued in Finnish Priority Application No. 20002429.

(Continued)

*Primary Examiner*—S. Gravini
(74) *Attorney, Agent, or Firm*—Stiennon & Stiennon

(57) ABSTRACT

An apparatus for a dryer section of a paper or board machine has a drying group (R) and an impingement drying unit (10) which is placed above and/or below a row (DSR) of drying cylinders (3). A drying fabric (1) supported paper or board web (2) is conducted past the impingement drying unit (10) having at least one impingement surface (IP1, IP2) the side profile of which is straight, changeably curved in its radius of curvature, in the shape of a broken line or a selectable combination of these, and that the impingement surface or a tangent line to the impingement surface or a line passing via the beginning and the end of the impingement surface or an extension of the line forms on the impingement side an angle with a horizontal plane parallel to the machine level, which angle is ≦120°, advantageously 120°–60°, most advantageously about 90°.

30 Claims, 9 Drawing Sheets

FOREIGN PATENT DOCUMENTS

| | | | |
|---|---|---|---|
| DE | 198 41 767 | A1 | 3/2000 |
| DE | 199 44 266 | A1 | 3/2001 |
| EP | 0 989 232 | A2 | 3/2000 |
| FI | 981331 | | 6/1998 |
| FI | 101985 | B | 9/1998 |
| FI | 102623 | B | 1/1999 |
| FI | 104194 | B | 11/1999 |
| FI | U20000114 | | 3/2000 |
| WO | WO 97/13031 | A1 | 4/1997 |
| WO | WO 99/55957 | A1 | 11/1999 |
| WO | WO 02/36880 | A1 | 5/2002 |

OTHER PUBLICATIONS

International Search Report issued in International Patent Application No. PCT/FI01/00963.

International Preliminary Examination Report issued in International Patent Application No. PCT/FI01/00963.

Markus Oeschle, Voith Sulzer Paper Technology, "Drying Concepts for High Demands" Paperi ja puu—Paper and Timber vol. 81/No. 8/1999.

* cited by examiner

PRIOR ART

IMPINGEMENT DRYING UNIT AND A DRYER SECTION

CROSS REFERENCES TO RELATED APPLICATIONS

This application is a U.S. national stage application of International Application No. PCT/FI01/00963, filed Nov. 6, 2001, and claims priority on Finnish Application No. 20002429, filed Nov. 6, 2000, the disclosure of each application being hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to an impingement drying unit for a dryer section of a machine making a fibrous web, advantageously a paper or board machine, which comprises at least one drying group and an impingement drying unit in which a fibrous web, advantageously a paper or board web, i.e. a web, has been arranged to be conducted past the impingement drying unit while supported by a drying fabric, such as a wire or equivalent.

The invention also relates to a dryer section of a machine making a fibrous web, advantageously a paper or board machine, which comprises at least one drying group applying single-wire draw or twin-wire draw, and an impingement drying unit for drying a fibrous web, advantageously a paper or board web, i.e. a web, and a drying fabric, such as a wire or equivalent on whose support the web has been arranged to be conducted past the impingement drying unit.

As known from the prior art, multi-cylinder dryers of paper machines employ twin-wire draw and/or single-wire draw. In twin-wire draw, the groups of drying cylinders comprise two wires which press the web, one from above and the other one from below, against heated cylinder surfaces. Between the rows of drying cylinders, which are usually horizontal rows, the web has free and unsupported draws which are susceptible to fluttering, which may cause web breaks, in particular as the web is still relatively moist and, therefore, has a low strength. Therefore, ever increasing use has been made of said single-wire draw in which each group of drying cylinders comprises only one wire on whose support the web runs through the entire group so that the wire presses the web against the heated cylinder surfaces of the drying cylinders and the web remains at the side of the outside curve of the turning cylinders or rolls situated between the drying cylinders. Thus, in single-wire draw, the drying cylinders are arranged outside the wire loop, and the turning cylinders or rolls are arranged inside the loop. One problem in these prior-art arrangements has been presented by the cylinders and rolls which are situated outside the wire loop and which get soiled, wherefore it has been necessary to provide them with doctors to keep the surfaces clean.

With increasing speeds of paper machines, the runnability of a paper machine is, of course, also affected by the dryer section, whose length with the prior-art multi-cylinder dryers would, at high speeds, become very long. If it is imagined that a present-day multi-cylinder dryer were used at a web speed of 40 m/s, it would include about 70 drying cylinders, and its length in the machine direction would be about 180 m. In that case, the dryer would comprise about 12–15 separate wire groups and a corresponding number of draws over the group gaps. It is to be assumed that, in a speed range of 30–40 m/s, the runnability of the normal prior-art multi-cylinder dryers is not good because of open draws, which may additionally cause web breaks that reduce the efficiency of the paper machine. In a speed range of 30–40 m/s and at higher speeds, the prior-art multi-cylinder dryers applying single-wire draw would also become uneconomical because the cost of investment of an excessively long paper machine hall would be high.

A dryer section like the one shown in FIG. 1 is previously known from public FI patent application 981331, in which dryer section one of the cylinder drying groups in which a web runs on support of a wire, comprises an impingement drying unit 10 placed in the basement, i.e. below the machine level or machine line parallel to the horizontal plane of the paper machine, which impingement drying unit includes a large-diameter cylinder 12 around which a wire 1 and a web 2 run, and in which impingement drying unit air impingement acts directly on the surface of the web 2. The total length of the dryer section can be shortened to some extent by this kind of impingement drying unit because the necessary drying capacity can be placed in a shorter space in the machine direction (MD).

FIG. 1 illustrates an example in which in the space required by three drying cylinders typically with a diameter of 1.8 m there are two drying cylinders with partial coverage and impingement below the machine level, the diameter of the impingement cylinder being 3.6 m and the coverage of air impingement being about 200°. In that connection, as compared with the drying capacity of the drying that applies single-wire draw, a higher drying capacity is achieved from the same horizontal space, i.e. the space taken by three drying cylinders, because of the impingement drying placed below.

Generally, the numerical relationship of drying capacities, expressed by the number of drying cylinders, can be estimated from the formula $$X_{cyl}/(Y_{cyl}+Z_{cyl}),$$

which, as applied to the above-mentioned exemplifying case, is $$3\ \text{cyl}/(1.5\ \text{cyl}+\Pi*3.6/1.7*200°/360°)\text{cyl}\approx\text{about } 3/5,$$

where 1.5 cyl is the drying capacity of about two drying cylinders with a smaller coverage than normal, and 1.7 follows from the fact that, on average, an impingement length of 1.7 m corresponds to the capacity of a 1.8-m diameter drying cylinder with normal coverage. Thus, in this numerical exemplifying case it is possible to achieve an additional drying capacity that corresponds to the drying capacity of about 2 drying cylinders. It must be emphasised that the large-diameter cylinder 12 situated below takes a considerable space in the direction of the machine line and the revolving mass increases with the large diameter of the cylinder.

The other problems which are manifested with ever higher emphasis at high speeds of the paper machine and for which satisfactory solutions have not yet been found, at any rate not for all of them, include the quality problems associated with the uniformity requirements of both the machine direction and the cross direction profiles of the paper web. The uniformity of the web being produced also influences the runnability of the entire paper machine and it is also an important quality factor of finished paper. Implementation of high speeds, in particular in wide machines, thus poses ever more difficult problems to be solved, of which the most important ones are the runnability and sufficient dewatering capacity of the machine at high speed.

One problem in paper machine dryer sections, when using conventional dryer sections composed of multi-cylinder dryers, is the noise caused by them. In addition, when cylinder drying is used, it is necessary to use steam, in which connection the drying cylinders must be designed to comply with pressure vessel regulations and, furthermore, the hood placed around the dryer section must be thermally insulated.

With respect to the state of the art relating to the invention, reference is made to FI patent 102623, which discloses a method in a paper machine or equivalent in which a web is dried in at least one drying group based on impingement drying or equivalent. In this prior-art arrangement, the web is guided along a substantially linear path or by using a large constant curve radius and in the drying stage, after impingement drying, the web or equivalent is dried in at least one drying group applying normal single-wire draw, and the web is passed from a pressing stage to the drying stage as a closed draw and so that the web is constantly supported against at least one support surface. The above-mentioned patent describes different types of applications for placing impingement drying units in a dryer section and in connection with arrangements of this type, reference is also made to the magazine article Markus Oeschle: "Drying concepts for high demands", Paperi ja Puu, Vol. 81, No. 8/1999.

SUMMARY OF THE INVENTION

It is an object of the invention to provide an impingement drying unit and a dryer section in which the above-noted drawbacks and problems known from the state of the art have been eliminated or at least minimised and by means of which an improved drying capacity is achieved with respect to the prior art.

In addition, it is an object of the invention to provide a drying arrangement that makes it possible to make dryer sections shorter than before as compared with prior-art dryer sections.

A further object of the present invention is to provide an impingement drying unit and a drying group in which good runnability and a substantially closed draw of the web can be achieved.

A further object of the invention is to make it possible to implement a drying concept in which good quality of paper and sufficiently undisturbed runnability are achieved.

A further object of the invention is to provide a drying arrangement and a dryer section applying it in which the web can be reliably supported over the entire length of the dryer section, whereby the cross direction shrinkage of the web can be substantially prevented, thereby avoiding the cross direction inhomogeneities of the web arising from a non-uniform cross direction shrinkage profile.

A still further object of the invention is to provide an impingement drying unit and/or a drying group in which the space below and/or above the drying unit or group is also made use of, which makes it possible to form new types of compact drying groups and dryer sections.

The aim of the present invention is thus to offer new solutions to the problems discussed above so that said drawbacks of the state of the art as well as those coming out later are mainly avoided.

The impingement unit in accordance with the invention is based on the new and inventive basic idea that the impingement drying unit extending at least partly above or below a horizontal plane which passes through the uppermost or lowermost drying cylinder(s) of a drying group and being parallel to the machine level, comprises at least one impingement surface or face, the side profile of which is straight, changeably curved in its radius of curvature, in the shape of a broken line or a selectable combination of these, and that the impingement surface or a tangent to the impingement surface or a line passing via the beginning and the end of the impingement surface or an extension of said line forms on the impingement side an angle of ≦120° with the horizontal plane parallel to the machine level.

The dryer section in accordance with the invention is based on the new and inventive basic idea that an impingement drying unit extending at least partly above or below a horizontal plane which passes through the uppermost or lowermost drying cylinder(s) of a drying group and being parallel to the machine level, comprises at least one impingement surface or face, the side profile of which is straight, changeably curved in its radius of curvature, in the shape of a broken line or a selectable combination of these, and that the impingement surface or a tangent line to the impingement surface or a line passing via the beginning and the end of the impingement surface or an extension of said line forms on the impingement side an angle of ≦120° with the horizontal plane parallel to the machine level.

Advantageously, in accordance with the invention, it is suitable to keep this angle in a range of 120°–60° on the impingement side to minimise the effect caused by the force of gravity and impeding the travel of the web/wire, so that the impingement drying unit is an impingement drying unit which is at least partly in an upright position. Particularly advantageously, said angle is about 90°, in which connection the impingement drying unit in accordance with the invention, as a unit that is narrow in the machine direction (MD) and placed in a substantially upright position, can be accommodated in a narrow space.

Thus, the impingement drying unit in accordance with a special embodiment of the invention is mainly characterised in that at least one impingement drying device of the impingement unit extending at least partly below or above a row of drying cylinders acts on at least one impingement surface, which is defined by the outer surface of a drying fabric running in the impingement drying unit, in which connection impingement acts directly on the web, and that the impingement surface is arranged to extend below and/or above the row of drying cylinders at least partly in a substantially upright position such that: the angle between a line passing along or a tangent line to or a line passing via the beginning and the end of at least one impingement surface of the impingement drying unit; or a line passing along or a tangent line to or a line passing via the beginning and the end of at least one part or run section or portion of a run section of an impingement surface of the impingement drying unit; or the centre-line or the symmetry line of the impingement drying unit; and a horizontal plane parallel to the machine level, is in a range of 120°–60°.

The dryer section in accordance with a special embodiment of the invention is in turn mainly characterised in that, in an impingement drying unit extending at least partly below or above a row of drying cylinders, at least one impingement drying device acts directly on at least one impingement surface, which is defined by the outer surface of a drying fabric running in the impingement drying unit, in which connection impingement acts directly on the web, and that the impingement surface is arranged at least mainly in a substantially upright position such that: the angle between a line passing along or a tangent line to or a line passing via the beginning and the end of at least one impingement surface of the impingement drying unit; or a line passing along or a tangent line to or a line passing via the beginning and the end of at least one part or run section or portion of a run section of an impingement surface of the impingement drying unit; or the centre-line or the symmetry line of the impingement drying unit; and a horizontal plane parallel to the machine level, is in a range of 120°–60°.

Because of the new and inventive structure which takes little space in the direction of the machine level or machine line, the length of the dryer section can be made shorter. Since impingement drying is more efficient than multi-cylinder drying, it is possible either to increase the drying capacity of the available space or to build the dryer section in its entirety to be substantially shorter than before as compared in particular with a dryer section formed of multi-cylinder dryers. A further advantage is that impingement drying is quicker than multi-cylinder drying in connection with the starting of the paper machine, which means that the web can be run to a desired quality substantially more quickly than allowed by mere drying cylinders.

In an impingement drying unit or in a dryer section in accordance with an advantageous embodiment of the invention, the impingement surface forms an angle with a horizontal plane parallel to the machine level or machine line, which angle is most advantageously about 90°.

In this application, by the inventive impingement drying unit, which is placed in an upright position and which extends at least partly below and/or above a horizontal plane which passes through a drying cylinder/cylinders and is parallel to the machine level, is generally meant all impingement drying units that comprise at least one impingement surface or a portion of such a surface the side profile of which is substantially straight in shape, changeably curved in its radius of curvature, in the shape of a broken line or a selectable combination of these, and in which a line passing via the beginning and the end of the impingement surface or a portion thereof forms, on the side of impingement, an angle of ≦120° with a horizontal plane parallel to the machine level, so that the adherence of the web and the wire to the impingement surface cannot yet be impaired too much by the force of gravity; advantageously, it is suitable to keep said angle in a range of 120°–60° to minimise the detrimental effect of the force of gravity. Particularly advantageously, said angle is about 90° both to eliminate the detrimental gravity of the force of gravity and to minimise the MD dimension of the impingement drying unit.

The invention also encompasses impingement drying units which are placed in an upright position and extend at least partly above and/or below a row of drying cylinders and have two impingement surfaces or portions of them disposed partly or totally symmetrically to each other, the side profiles of the impingement surfaces or portions of them being substantially straight in shape, changeably curved in their radii of curvature, in the shape of a broken line or any selectable combinations of these, and in which impingement drying unit, the symmetry line of the impingement surfaces or of their symmetric portions forms an angle of ≦120° with a horizontal plane parallel to the machine level, so that the adherence of the web and the wire to the impingement surface cannot yet be impaired too much by the force of gravity; advantageously, it is suitable to keep said angle in a range of 120°–60° to minimise the detrimental effect of the force of gravity. Particularly advantageously, said angle is about 90° not only to eliminate the detrimental effect of the force of gravity but also to minimise the MD dimension of the impingement drying unit.

Further, the invention encompasses an impingement drying unit which is placed in an upright position and extends at least partly above and/or below a horizontal plane which passes through a drying cylinder/cylinders and is parallel to the machine level, and which impingement drying unit has impingement surfaces disposed asymmetrically to each other, the side profiles of the impingement surfaces being substantially straight in shape, changeably curved in their radii of curvature, in the shape of a broken line or any selectable combinations of these, and in which impingement drying unit the impingement surface or a line passing via its beginning and end forms on the impingement side an angle of ≦120° with a horizontal plane parallel to the machine level, so that the adherence of the web and the wire to the impingement surface cannot yet be impaired too much by the force of gravity; advantageously, it is suitable to keep said angle in a range of 120°–60° to minimise the detrimental effect of the force of gravity. Particularly advantageously, said angle is about 90° to eliminate the detrimental gravity of the force of gravity and to minimise the MD dimension of the impingement drying unit.

In connection with the invention, it must be emphasized that, in addition to the impingement surface side profile having a straight general shape or a general shape which is changeably curved in its radius of curvature, the impingement surface can be formed of successive substantially straight and/or curved parts, which are at a selectable angle with respect to one another, in which connection the shape of the side profile of a single impingement surface can be straight in its entirety or curved in its entirety or in the shape of a broken line or a selectable combination of the above-mentioned side profile shapes.

In addition, it shall be noted that the impingement drying unit may comprise only one impingement surface provided with air impingement, the shape of the side profile of which impingement surface may be straight or changeably curved in its radius of curvature or a broken line or a selectable combination of these, in which connection the upright position generally means that the angle between a line between the beginning and the end of the impingement surface and a horizontal plane parallel to the machine level is on the impingement side ≦120°, advantageously in a range of 120°–60° and, in accordance with a particularly advantageous embodiment of the invention, the angle is about 90°.

The impingement drying unit may also comprise two impingement surfaces that are asymmetrical in shape or in position. In that connection, the upright position in accordance with the invention means that both impingement surfaces or a line between the beginning and the end of an impingement surface forms on the impingement side an angle with a horizontal plane parallel to the machine level, which angle is ≦120°, advantageously 120°–60°.

When the impingement surfaces are parallel, the angle is typically about 90°.

When the impingement surfaces converge symmetrically towards a row of drying cylinders, it is advantageous to select the angle from a range of 60°–90°, advantageously the angle is in that case about 75°.

In the invention, to further improve runnability and to prevent shrinkage of the web, the web to be dried with impingement is supported by means of vacuum devices, for example, blow/suction boxes and/or suction rolls and/or active rolls which generate suction power from their own rotational energy.

In the arrangement in accordance with the invention there is less revolving mass as compared with conventional multi-cylinder drying, whereby the problems arising from vibration are minimised. Moreover, the planning of the foundation is therefore less expensive and the foundation can be constructed to be lighter.

In one advantageous application in accordance with the invention, both sides of the web can be dried by the impingement drying unit according to the invention, thereby making it possible to reduce the curl of the web in the cross direction (CD) transverse to the machine direction (MD).

BRIEF DESCRIPTION OF THE DRAWINGS

In the following, the invention will be described in more detail with reference to the figures in the appended drawings.

DESCRIPTION OF THE PREFERRED EMBODIMENTS

Figure 1:
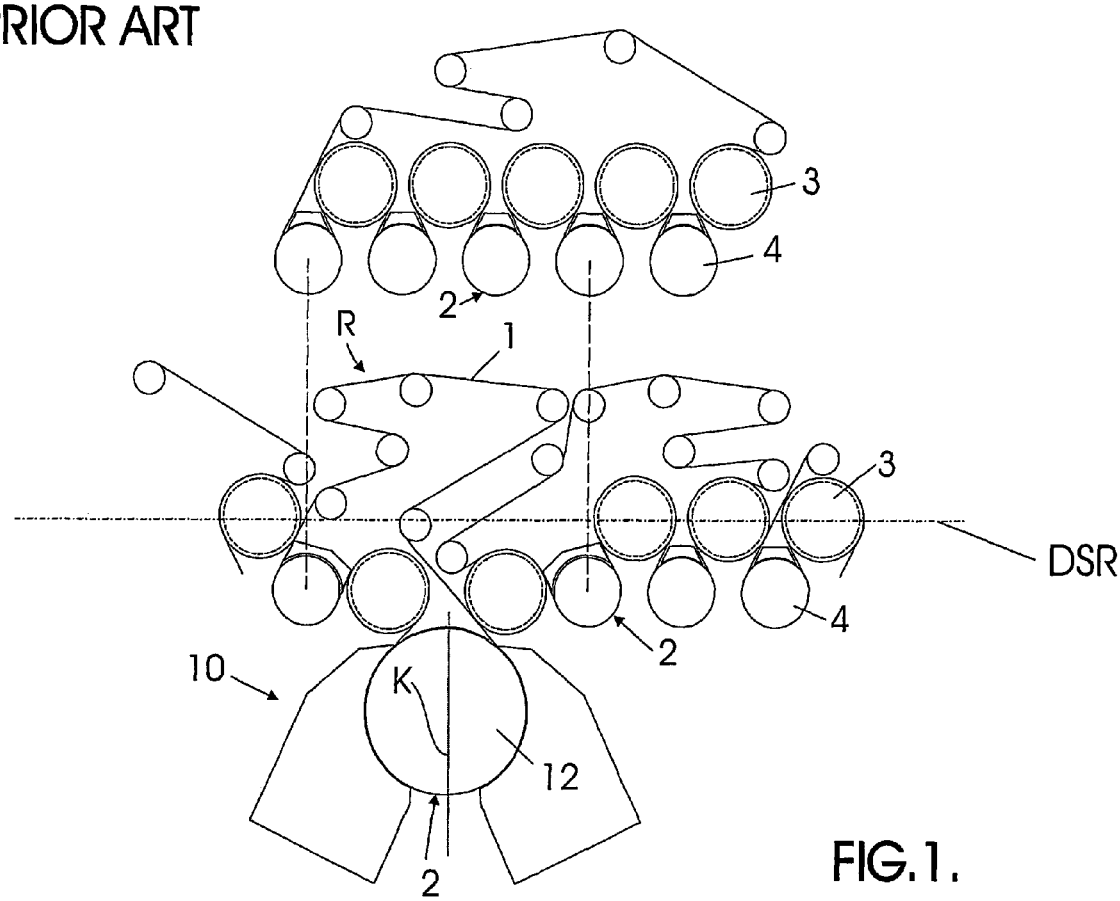
FIG. 1 shows an arrangement in accordance with the prior art for arranging drying in a dryer section of a paper machine.

In the following, a first advantageous exemplifying embodiment of the invention will be described with reference to FIGS. 2, 3 and 4. In this exemplifying embodiment, in an impingement drying unit 10, a drying fabric 1, such as a wire or equivalent, hereafter a wire 1, supporting a fibrous web 2, advantageously a paper or board web, hereafter a web 2, and forming a wire loop 11 runs around an auxiliary turning roll 14 at that end of the impingement drying unit 10 which is situated away from a row DSR of drying cylinders 3, and the impingement drying unit 10 comprises two impingement surfaces IP1 and IP2 for the web 2, which impingement surfaces are arranged advantageously in an upright position and defined by the outer surface of the wire 1 supporting the web 2.

Figure 2:
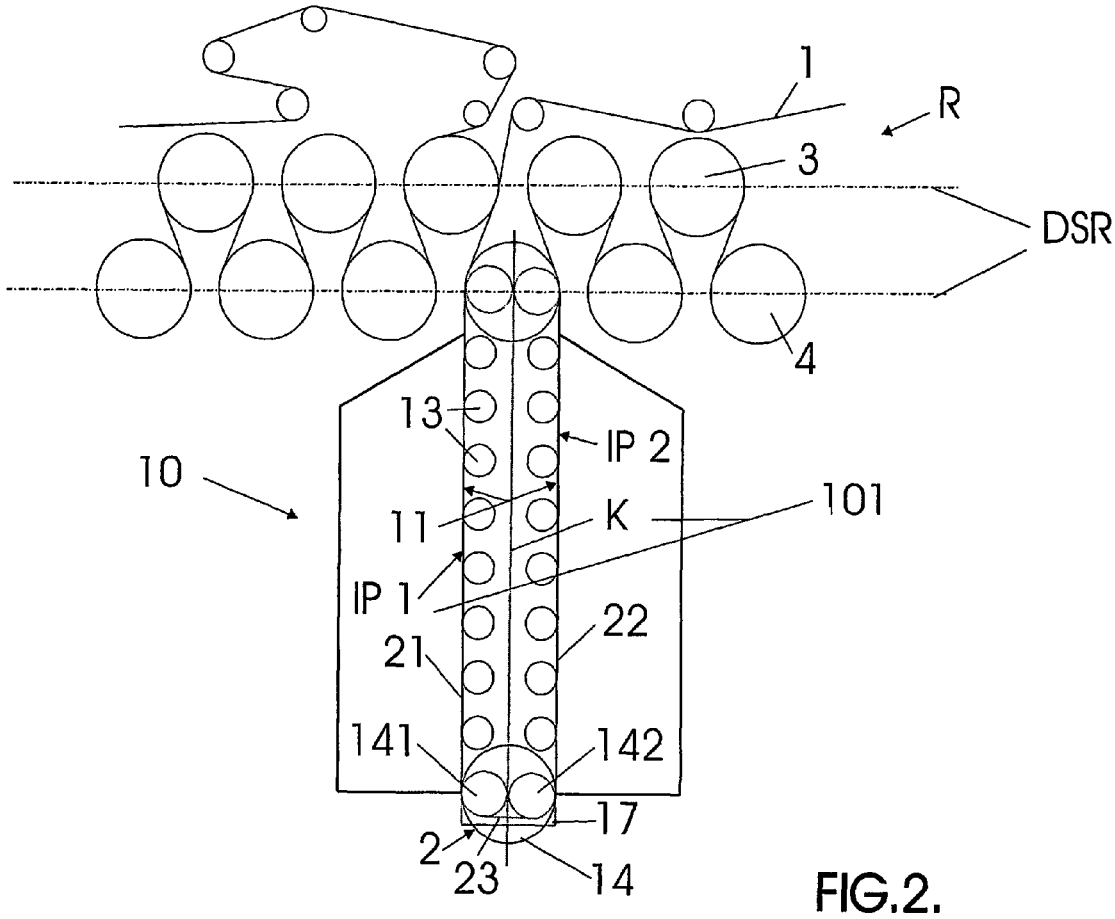
FIG. 2 is a schematic view of a first advantageous exemplifying embodiment of the invention in a dryer section that applies single-wire draw, as arranged to form a part of a drying group below the drying group.
Figure 3:
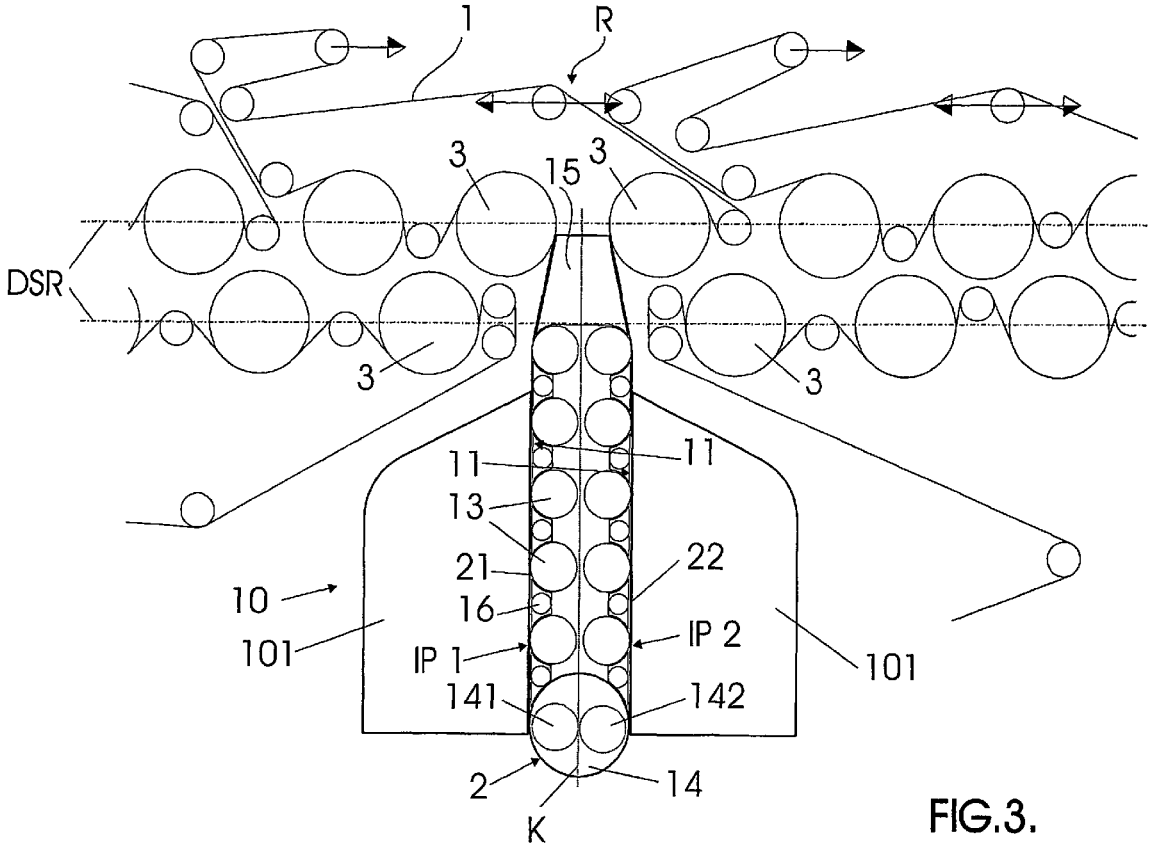
FIG. 3 is a schematic view of the first advantageous exemplifying embodiment of the invention in a dryer section that applies twin-wire draw, as arranged to form a part of a drying group below the drying group.
Figure 4:
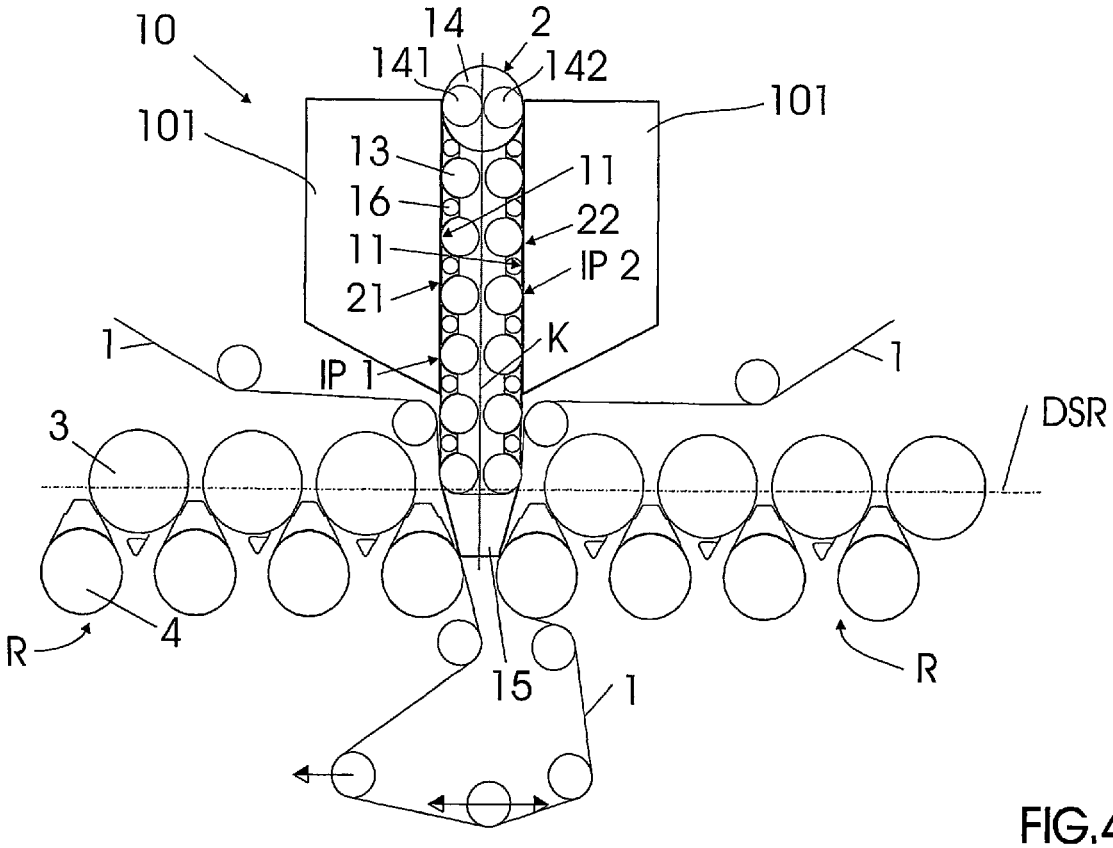
FIG. 4 is a schematic view of the first advantageous exemplifying embodiment of the invention in a dryer section that applies single-wire draw, as arranged between two drying groups above the drying groups.

It is also advantageous that in this first exemplifying embodiment of the invention shown in FIGS. 2, 3 and 4 the impingement drying unit 10 incorporates as a runnability component a blow or vacuum device 15, which is disposed at that end of the impingement drying unit which is on the side of the row DSR of the drying cylinders 3 and which produces a vacuum behind the wire, thereby helping the web 2 to adhere to the wire 1 and thus improving the runnability of the web 2 and the wire, in particular their run to the impingement drying unit 10 and away from the impingement drying unit. FIGS. 2, 3 and 4 additionally illustrate by an interrupted line an alternative embodiment of a single auxiliary turning roll 14, according to which two or more auxiliary turning rolls 141, 142 can be used in the place of a single auxiliary turning roll 14. When several auxiliary turning rolls 141, 142 are used at that end of the impingement drying unit which is away from the row DSR of the drying cylinders 3, at least a substantially horizontal, i.e. horizontal or obliquely ascending or obliquely descending run section 23 of the web run can be provided with an additional impingement device 17, which has been illustrated by an interrupted line in FIG. 2, to direct impingement directly at the surface of the web 2 in at least the substantially horizontal run section 23 between the auxiliary turning rolls 141 and 142. In connection with the additional impingement device 17 it must be noted that it can be disposed as a separate element in a trough-like fashion on the turning roll 14 or on an auxiliary turning roll/auxiliary turning rolls 141, 142, and that the additional impingement device can be integrated with an impingement device 101 to form a part of it.

In this first exemplifying embodiment of the invention, both impingement surfaces IP1 and IP2 placed in a substantially upright position include a straight, substantially vertical run section 21, 22, which run sections are substantially parallel to each other and run advantageously symmetrically on both sides of the centre-line K of the impingement drying unit 10 in accordance with the invention. Both run sections 21, 22 are provided with an impingement drying device 101 which is situated outside the wire loop 11 and which applies a direct impingement air jet to the surface of the web 2.

In the impingement drying unit 10, a support structure or a frame structure has been placed inside the wire loop 11, the support or frame structure comprising means for supporting and guiding the run of the wire 1 and the web 2 supported by it.

Figure 9:
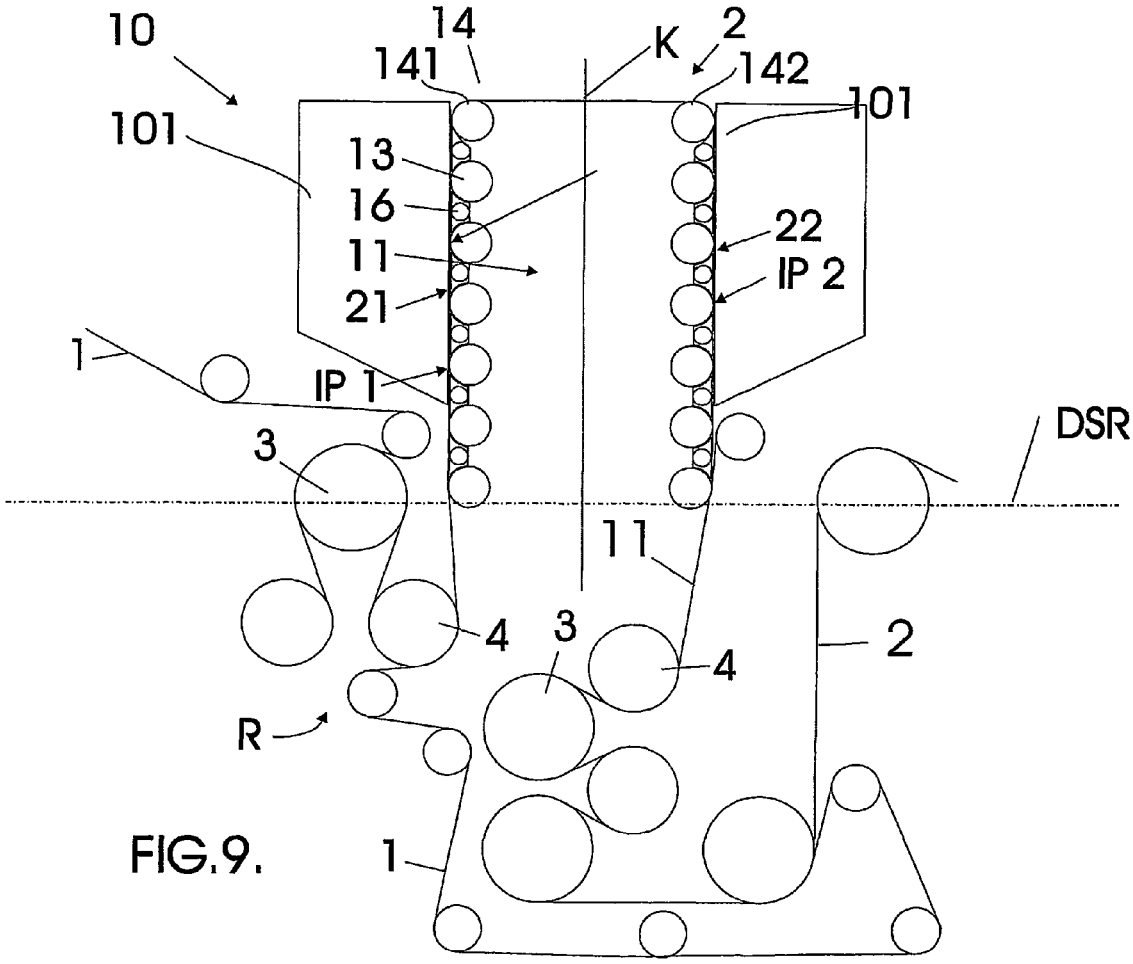
FIG. 9 is a schematic view of a sixth advantageous exemplifying embodiment of the invention in a dryer section that applies single-wire draw, as arranged to form a part of a drying group and extend above a horizontal plane which passes through the uppermost drying cylinders of the dryer section and is parallel to the machine level, and to be associated with drying cylinders and turning rolls arranged vertically with respect to the machine level of the drying group.

Reference is made to FIG. 9 which schematically shows a sixth advantageous exemplifying embodiment of the invention in a dryer section that applies single-wire draw, as arranged to form a part of a drying group and extend above a horizontal plane which passes through the uppermost drying cylinders of the dryer section and is parallel to the machine level, and to be associated with drying cylinders and turning rolls of the drying group arranged vertically with respect to the machine level.

This sixth exemplifying embodiment of the invention shown in FIG. 9 differs from the first exemplifying embodiment of the invention shown in FIG. 4 essentially only in that an impingement unit 10 placed in an upright position is associated with a group of drying cylinders 3 and turning cylinders 4 placed in an upright position with respect to the machine level. In that connection, the impingement unit 10, the drying cylinders 3 and the turning cylinders 4 placed in an upright position allow in the paper machine a very short total length of the drying group in the machine direction while, at the same time, the drying capacity of the drying group is high.

In the following, a second advantageous exemplifying embodiment of the invention will be described with reference to FIG. 5. In this second exemplifying embodiment, in an impingement drying unit 10, a drying fabric 1, such as a wire or equivalent, hereafter a wire 1, supporting a fibrous web 2, advantageously a paper or board web, hereafter a web 2, and forming a wire loop 11 runs around an auxiliary turning roll 14 situated at the lower end of the impingement drying unit 10, said lower end being situated away from a row DSR of drying cylinders 3 and said impingement drying unit extending from inside a drying group R below the drying group R. The impingement drying unit 10 comprises two impingement surfaces IP1 and IP2 for the web 2, which impingement surfaces are arranged advantageously in an upright position and defined by the outer surface of the wire 1 supporting the web 2.

Figure 5:
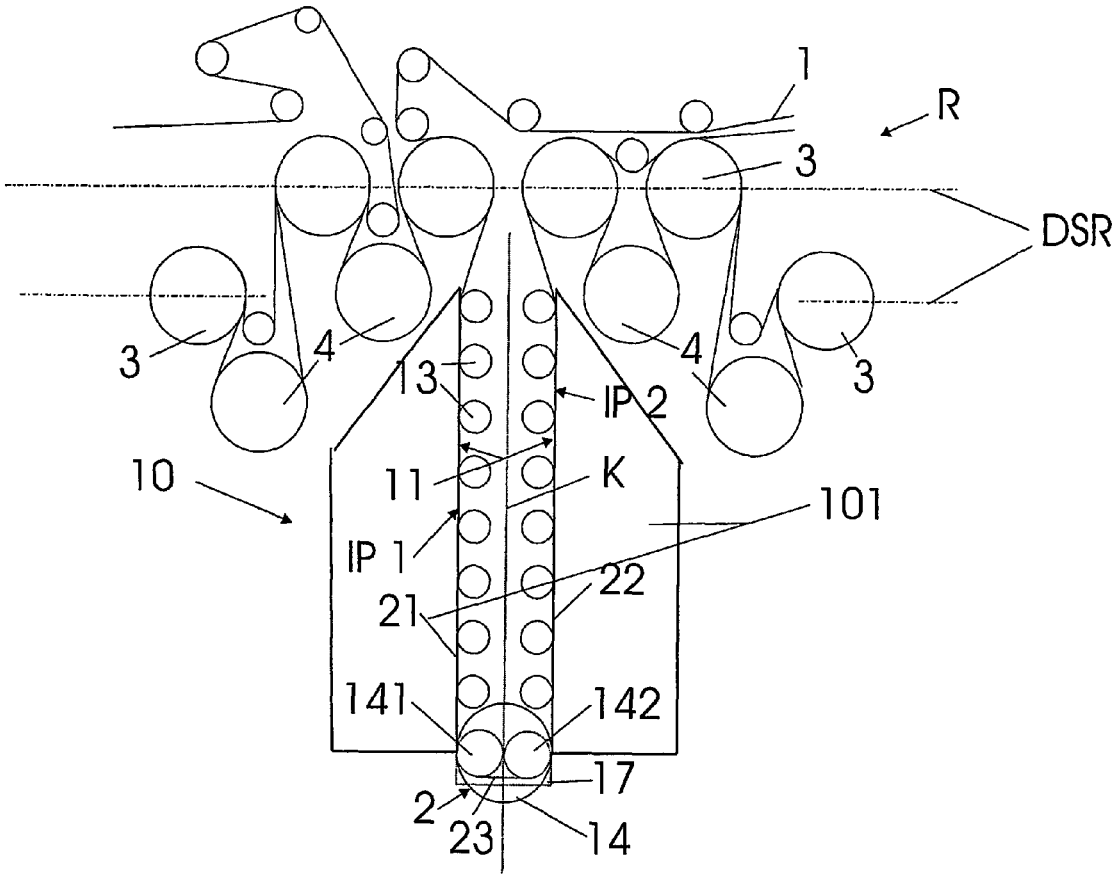
FIG. 5 is a schematic view of a second advantageous exemplifying embodiment of the invention in a dryer section that applies single-wire draw, as arranged to form a part of a drying group in which some of the drying cylinders of the drying group, i.e. drying cylinders at the beginning of the dryer section, are in an elevated position with respect to the other drying cylinders of the drying group and in which the impingement unit extends from inside the drying group below the drying group.

It is advantageous that in this second exemplifying embodiment of the invention shown in FIG. 5 the impingement drying unit 10 also incorporates as a runnability component a blow or vacuum device (15, cf. FIGS. 3 and 4), which is advantageously disposed at that end of the impingement drying unit R which is on the side of the row DSR of the drying cylinders 3 and which produces a vacuum behind the wire, thereby helping the web 2 to adhere to the wire 1 and thus improving the runnability of the web 2 and the wire, in particular their run to the impingement drying unit 10 and away from the impingement drying unit 10.

FIG. 5 additionally illustrates by an interrupted line an alternative embodiment of a single auxiliary turning roll 14, according to which two or more auxiliary turning rolls 141, 142 can be used in the place of a single auxiliary turning roll 14. When several auxiliary turning rolls 141, 142 are used at that end of the impingement drying unit 10 which is away from the row DSR of the drying cylinders 3, at least a substantially horizontal, i.e. horizontal run section 23 of the web run, which run section may also be obliquely ascending or obliquely descending, can be provided with an additional impingement device 17, which has been illustrated by an interrupted line in FIG. 5, to direct impingement directly at the surface of the web 2 in the run section 23 between the auxiliary turning rolls 141 and 142, said run section 23 being parallel to the horizontal plane parallel to the machine level. In connection with the additional impingement device 17 it must be noted that it can be disposed as a separate element in a trough-like fashion on the turning roll 14 or on an auxiliary turning roll/auxiliary turning rolls 141, 142. The additional impingement device 17 can also be integrated with an impingement device 101 to form a part of it.

In this second exemplifying embodiment of the invention shown in FIG. 5, both impingement surfaces IP1 and IP2 placed in a substantially upright position include a substantially vertical run section 21, 22. The vertical run sections run at a substantially right angle to a horizontal plane parallel to the machine level and advantageously symmetrically and parallel to each other on both sides of the centre-line K of the impingement drying unit 10 in accordance with the invention. Both run sections 21, 22 are additionally provided with an impingement drying device 101 which is situated outside the wire loop 11 and which applies a direct impingement air jet to the surface of the web 2.

In the impingement drying unit 10, it is advantageous that a support structure or a frame structure is placed inside the wire loop 11, the support or frame structure comprising means for supporting and guiding the run of the wire 1 and the web 2 supported by it in the impingement unit 10.

Figure 6:
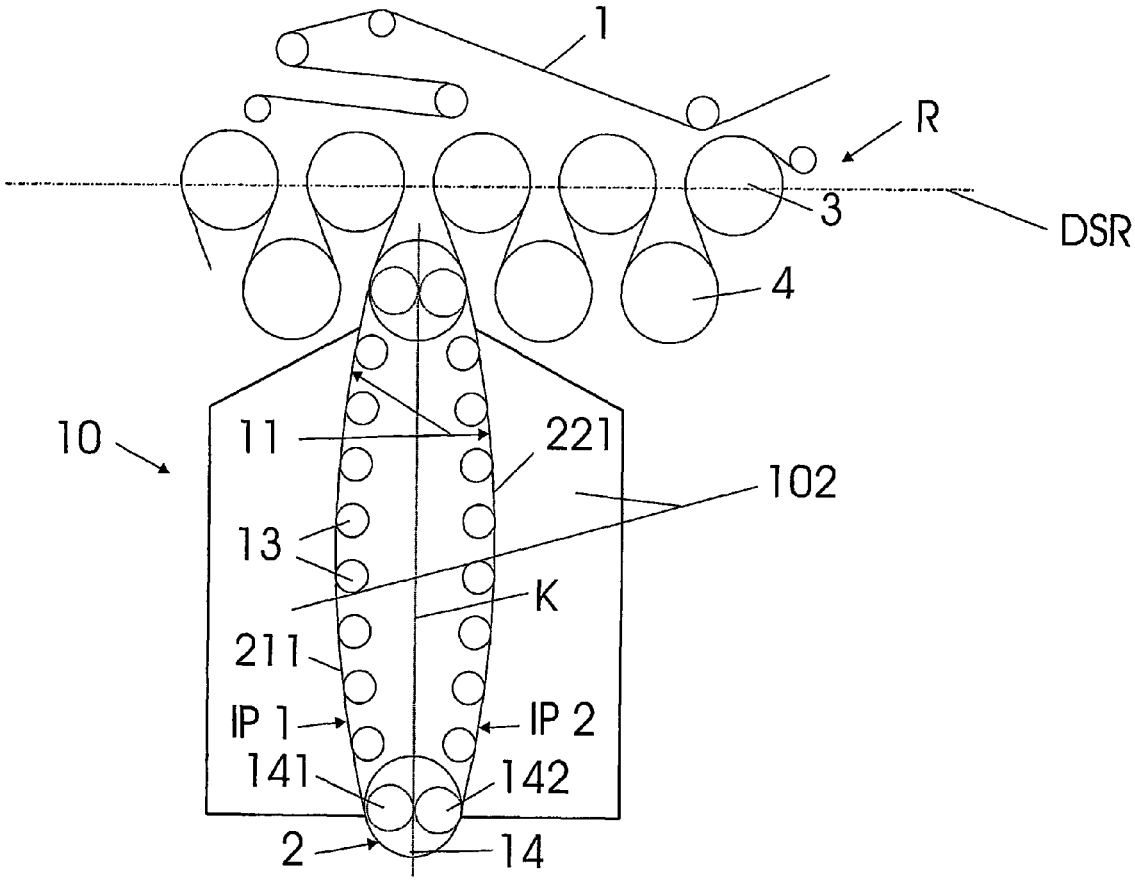
FIG. 6 is a schematic view of a third advantageous exemplifying embodiment of the invention in a dryer section that applies single-wire draw, as arranged to form a part of a drying group below the drying group.

With reference to FIG. 6, a third advantageous exemplifying embodiment of the invention will be described below. In this exemplifying embodiment, in an impingement drying unit 10, a wire 1 supporting a web 2, forming a wire loop 11 and running around an auxiliary turning roll 14 comprises two impingement surfaces IP1 and IP2 for the web 2, which surfaces are in a substantially upright position and defined by the outer surface of the wire 1 supporting the web 2. This impingement drying unit 10 in accordance with the third exemplifying embodiment shown in FIG. 6 can be provided with a runnability component in the same manner as described above in connection with the first exemplifying embodiment of the invention, which runnability component is advantageously a blow or vacuum device (cf. 15, FIGS. 3 & 4) which is disposed at that end of the impingement drying unit 10 which is on the side of a row DSR of drying cylinders 3. FIG. 6 additionally illustrates by an interrupted line an alternative embodiment of a single auxiliary turning roll 14, according to which two or more auxiliary turning rolls 141, 142 can be used in the place of a single auxiliary turning roll 14. When several auxiliary turning rolls 141, 142 are used at that end of the impingement drying unit 10 which is away from the row DSR of the drying cylinders 3, at least a substantially horizontal, i.e. horizontal or obliquely ascending or obliquely descending run section (cf. 23, FIG. 2) of the web run can be provided with an additional impingement device, which in FIG. 2 has been illustrated by an interrupted line and denoted with the reference numeral 17, to direct additional impingement directly at the surface of the web 2 in the substantially horizontal run section between the auxiliary turning rolls 141 and 142. As already stated above in connection with the first exemplifying embodiment of the invention, such an additional impingement device 17 can be disposed as a separate element in a trough-like fashion on the turning roll 14 or on an auxiliary turning roll/auxiliary turning rolls 141, 142, and that the additional impingement device can be integrated with an impingement device 101 to form a part of it.

In this third exemplifying embodiment of the invention shown in FIG. 6, both impingement surfaces IP1 and IP2 placed in a substantially upright position include a run section 211, 221 having a radius of curvature which can be changeably curved inwards or, as shown in FIG. 6, outwards. The run sections can also be formed of successive straight parts which are at an angle to one another, in which connection the run sections run in the shape of a broken line directed inwards or outwards with respect to the centre-line K of the impingement device 10. Advantageously, the run sections 211, 221 run symmetrically on both sides of the centre-line K of the impingement drying unit 10 in accordance with the invention. Thus, in accordance with the invention, both run sections 211 and 221 having a changeably curved radius of curvature or being in the shape of a broken line are provided with an impingement device 102, which is situated outside the wire loop 11 and which applies a direct impingement air jet to the surface of the web 2.

In the impingement drying unit 10, means are placed inside the wire loop 11 for supporting and guiding the run of the wire 1 and the web 2.

Figure 7:
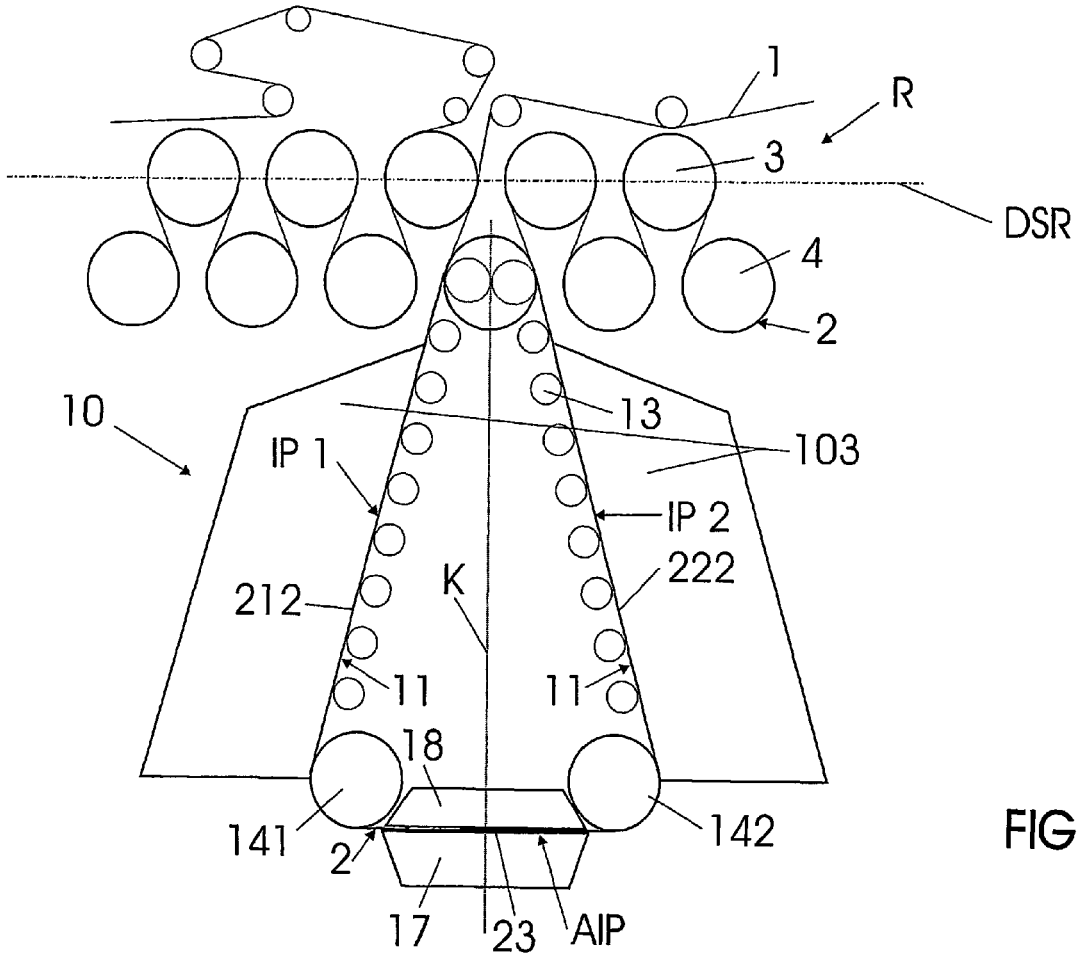
FIG. 7 is a schematic view of a fourth advantageous exemplifying embodiment of the invention in a dryer section that applies single-wire draw, as arranged to form a part of a drying group below the drying group.
Figure 8:
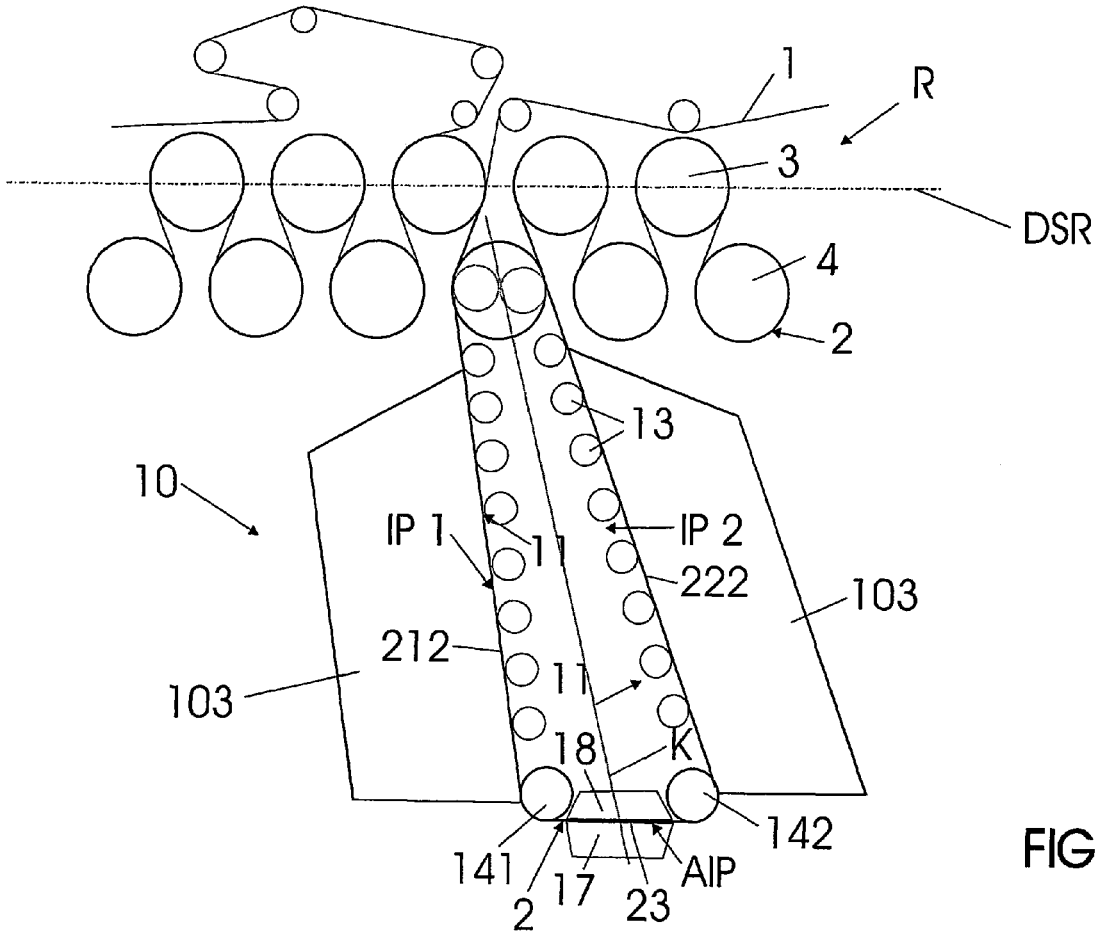
FIG. 8 is a schematic view of a fifth advantageous exemplifying embodiment of the invention in a dryer section that applies single-wire draw, as arranged to form a part of a drying group below the drying group.

With reference to FIGS. 7 and 8, fourth and fifth advantageous exemplifying embodiments of the invention are described below. In these exemplifying embodiments, a wire 1 which supports a web 2, forms a wire loop 11 and runs around two auxiliary turning rolls 141 and 142, runs along a substantially triangular web run which is composed of successive run sections 212, 23, 222 and comprises two impingement surfaces IP1 and IP2 for the web 2, which impingement surfaces are in a substantially upright position and defined by the outer surface of the wire 1 supporting the web 2. In that connection, the triangular web run includes a substantially horizontal additional impingement surface AIP, which is between the auxiliary turning rolls 141 and 142 and which is defined by the outer surface of the wire 1 running between the auxiliary turning rolls 141 and 142 and supporting the web 2.

The first and second impingement surfaces IP1 and IP2, respectively, situated in an upright position are at an angle at least partly deviating from a right angle with respect to a horizontal plane parallel to the machine level and form two run sections 212 and 222 of the triangular run, which run sections are at an angle with respect to a row DSR of drying cylinders 3 in a drying group R and converge towards each other.

In the fourth exemplifying embodiment of the invention shown in FIG. 7, the impingement surfaces IP1 and IP2 and their run sections 212 and 222 are, in the fourth exemplifying embodiment of the invention shown in FIG. 7, on the side of their impingement air jets, substantially at the same angles of about 75° to a horizontal plane parallel to the machine level and converge symmetrically on both sides of the centre-line K of the impingement drying unit 10 towards the row DSR of the drying cylinders.

In the fifth exemplifying embodiment of the invention shown in FIG. 8, the impingement surfaces IP1 and IP2 and the respective run sections 212 and 222 associated therewith are on the side of their impingement air jets at different angles, which are on the side of their impingement air jets in a range of 120°–60° and which are ≠90°, to a horizontal plane parallel to the machine level and, in addition, the centre-line K of the entire impingement drying unit is also inclined at an angle of ≠90° to the horizontal plane parallel to the machine level. The converging impingement surfaces IP1 and IP2 shown in FIGS. 7 and 8 as well as their run sections 212 and 222 are both provided with their own impingement device 103, which is placed outside the wire loop 11 and which applies a direct impingement air jet to the surface of the web 2. Moreover, it is advantageous that at least the run section 23 of the web run which is substantially horizontal, i.e. horizontal or obliquely ascending or obliquely descending, is provided with an additional impingement device 17 to direct impingement directly at the surface of the web 2 in the substantially horizontal run section 23 between the auxiliary turning rolls 141 and 142, which run section 23 is situated against the additional impingement surface AIP. As already noted above in connection with the first exemplifying embodiment of the invention, such an additional impingement device 17 can be disposed as a separate element in a trough-like fashion on the turning roll 14 or on an auxiliary turning roll/auxiliary turning rolls 141, 142, and that the additional impingement device can be integrated with the impingement device 101 to form a part of it.

In the impingement drying device 102, means 13 (16, cf. FIG. 4) are placed inside the wire loop 11 for supporting and guiding the run of the wire 1 and the web 2.

It must be generally noted that, in particular in connection with impingement, the web 2 shall be supported and guided from the side opposite to the impingement. For this purpose, the devices which are disposed inside the wire loop 11 and which support and guide the run of the wire 1 and the web 2 supported by it, include, for example, support rolls 13, such as, for example, suction rolls, and/or vacuum devices and/or blow/suction boxes 16 (cf. FIGS. 3 and 4) and/or other support means placed between the support rolls for enabling runnability to be enhanced, such as, for example, active rolls which generate suction power from their own rotational energy, and which simultaneously assist in preventing shrinkage of the web 2. The wire loop 11 is advantageously placed outside the frame structure which supports all the means 13, 16 which are situated inside the wire loop 11 in the drying group R and by which the run of the web 2 and the wire 1 is guided and/or supported in the impingement drying unit 10 in accordance with the invention. The frame structure may be formed of, for example, two beam-like arms extending in substantially opposite directions, the support rolls 13 being placed at the end of both arms to assure the run of the wire 1 and the web 2. The wire 1 can be guided and tensioned by a combined guide-tension device (not shown in the figures), which comprises a guide roll and a tensioning roll as well as an actuator connected to the combined device, for example, a pressure cylinder. In that connection, the position of the tensioning roll in the combined device can be adjusted by the actuator such that the tension of the wire 1 is suitable.

In the exemplifying embodiment shown in FIG. 2, the impingement drying unit 10 has been disposed in connection with one drying group R applying single-wire draw in a dryer section, so that the impingement drying unit 10 is placed below the drying group R in the machine direction, which in FIG. 2 is from the left to the right, directly beneath a first turning roll 4 of the drying group, and the wire loop 11 is formed of the wire 1 of the drying group R. The wire 2 comes from the first turning roll 4 of the right-hand drying group R applying single-wire draw downwards to the inlet side of the impingement drying unit 10, from which the first impingement surface IP1 provided for the web 2 and directed away from the drying group R, i.e. downwards in the figure, and the substantially straight first run section 21 associated therewith begin. After the first impingement surface IP1, the wire 1 runs around the auxiliary turning roll 14, after which the second impingement surface IP2 provided for the web 2 and directed towards the drying group R, i.e. upwards in FIG. 2, and the second substantially straight run section 22 associated therewith begin. After the second impingement surface IP2, the wire 1 returns from the outlet side of the impingement drying unit 10 to the first turning roll of the drying group R. After the impingement drying unit 10, the wire 1 and the web 2 meander together around the other drying cylinders 3 and turning rolls 4 of the drying group.

Thus, in the exemplifying embodiment shown in FIG. 2, in the first run section 21 of the impingement drying unit 10, the web 2 runs against the first impingement surface IP1 as substantially straight in a direction away from the drying group R and, after that, in the second run section 22, against the second impingement surface IP2 as substantially straight towards the drying group R. To turn the run of the web 2 away so as to be directed towards the drying group R, the impingement drying unit 10 is provided with a turning device which is formed of the auxiliary turning roll 14 or another auxiliary means for changing direction. Alternatively, the single auxiliary turning roll 14 can be replaced with two auxiliary turning rolls 141 and 142, as illustrated by an interrupted line in FIG. 2. Depending on the distance between the first and the second substantially upright run section 21, 22 in the horizontal direction, an additional impingement device 17 can be disposed in the run section 23 of the web run between the auxiliary turning rolls 141, 142, which run section is substantially horizontal, i.e. horizontal or obliquely ascending or obliquely descending. Also, the normal turning cylinder 4 of the drying group can be replaced, when needed, with two smaller-diameter guide rolls of the web 2 to guide the run of the web 2 and the wire 1 from the drying cylinder 3 to the impingement drying unit 10 and vice versa.

In the exemplifying embodiment of FIG. 2, the first impingement surface IP1 directed away from the drying group R, placed in a substantially upright position and defined by the outer surface of the wire 1, and the first run section 21 as well as the second impingement surface IP2 directed towards the drying group R, placed in a substantially upright position and defined by the outer surface of the wire 1, and the second run section 22 are substantially parallel and advantageously form, on the side of impingement, an angle of about 90° with a horizontal plane parallel to the machine level. In that connection, it is also advantageous that the impingement surfaces IP1 and IP2 as well as the run sections 21 and 22 are situated symmetrically on both sides of the centre-line K of the impingement drying unit 10, i.e. the symmetry line of the impingement surfaces, in which connection the centre-line K of the impingement drying unit 10 or the symmetry line of the impingement surfaces IP1 and IP2 is also at said angle of about 90° to a horizontal plane parallel to the machine level. By inclining the impingement drying unit 10, said angle formed with the horizontal plane parallel to the machine level can be changed so that it differs from said about 90°, however, it is advantageous that said angle is kept below 120° on the side of impingement and, in particular to minimise the detrimental effect of the force of gravity, advantageously in a range of 120°–60°.

In the exemplifying embodiment shown in FIG. 2, in the impingement drying unit 10 there are two impingement devices 101 on the vertical run sections 21, 22 of the wire loop 11 such that the first impingement device 101 applies an impingement air jet directly to the web 2, which runs as substantially straight in a direction away from the drying group R lying against the first impingement surface IP1 and along the run section 21, and such that the second impingement device 101 applies an impingement air jet directly to the web 2, which runs as substantially straight towards the drying group R lying against the second impingement surface IP2 along the second run section 22. It shall be noted that, in addition to the exemplifying embodiment illustrated, the invention also encompasses impingement drying units 10 and dryer sections and drying groups R provided with such units which have a different number of impingement drying devices 101 or impingement surfaces IP1, IP2. The impingement drying unit 10 in accordance with the invention thus includes at least one impingement surface and at least one impingement drying device acting on it.

In the exemplifying embodiment shown in FIG. 3, the impingement drying unit 10 in accordance with the first exemplifying embodiment of the invention has been disposed in connection with one drying group R applying twin-wire draw in a dryer section, so that the impingement drying unit 10 is placed, in a horizontal plane parallel to the machine level and in the machine direction (MD), which in FIG. 3 is from the left to the right, substantially below the rows DSR of the drying cylinders 3 of the drying groups R, between two successive drying cylinders 3 belonging to the same cylinder row, substantially in the place of a drying cylinder 3 of the lower row. In this exemplifying embodiment of the invention, the wire loop 111 is formed of the wire 1 of the drying group R. The wire 1 comes from a drying cylinder 3 of the drying group applying twin-wire draw to the inlet side of the impingement drying unit 10, from which the first substantially vertical impingement surface IP1 of the impingement drying unit provided for the web 2 and directed away from the drying group R, said impingement surface being defined by the outer surface of the wire 1, and the substantially straight first run section 21 associated with the first impingement surface IP1 begin. After the first run section 21, the wire 1 runs around the auxiliary turning roll 14, after which the second substantially vertical impingement surface IP2 provided for the web 2 and directed towards the drying group R begins, which impingement surface is also defined by the outer surface of the wire 1 and with which the second substantially straight run section 22 is associated. After the second impingement surface IP2, the web 2 and the wire 1 return from the outlet side of the impingement drying unit 10 to a drying cylinder 3 of the drying group R.

In the exemplifying embodiment of FIG. 3, the web 2 thus runs in the impingement drying unit 10 first in the first run section 21 lying against the first impingement surface IP1 along a substantially linear path in a direction away from the drying group R and then in the second run section 22 lying against the second impingement surface IP2 along a substantially linear path towards the drying group R. To turn the running direction of the web 2 from away from the drying group R towards the drying group R, the impingement drying unit 10 comprises a turning device which is composed of the auxiliary turning roll 14 or another auxiliary means for changing direction. The single auxiliary turning roll 14 can be replaced with two auxiliary turning rolls 141 and 142, as illustrated by an interrupted line in FIG. 3. Depending on the distance in the horizontal direction between the first and second impingement surfaces IP1 and IP2, placed in a substantially upright position, or between the run sections 21, 22, placed in an upright position, an additional impingement device (17, cf. FIGS. 2 & 6) acting on the web 2 can be disposed in the run section 23 between the auxiliary turning rolls 141, 142, which run section is substantially horizontal, i.e. horizontal or obliquely ascending or obliquely descending and, at that end of the impingement drying unit 10 which is on the side of the row DSR of the drying cylinders 3, it is possible to use either one turning cylinder or, as shown in FIG. 3, two guide rolls for guiding the run of the web 2 and the wire 1 from a drying cylinder 3 to the impingement drying unit 10 and vice versa. The end of the impingement drying device 101 of the invention on the side of the row DSR of the drying cylinders 3 is advantageously provided with a blow device 15, which functions as a runnability component which generates a vacuum under the wire 1 and by means of which the run of the web 2 and the wire can be supported from the drying cylinder 3 to the impingement drying unit 10 and vice versa.

In the exemplifying embodiment shown in FIG. 3, the first impingement surface IP1 directed away from the drying group R and placed in a substantially upright position as well as the first run section 21 associated therewith and the second impingement surface IP2 directed towards the drying group R and placed in a substantially upright position as well as the second run section 22 associated therewith are parallel to one another and form, on the side of impingement, an angle of about 90° with a horizontal plane parallel to the machine level. It is advantageous that the impingement surfaces IP1 and IP2 are also situated symmetrically on both sides of the centre-line K of the impingement drying unit 10, in which connection the centre-line or the symmetry line K of the impingement surfaces is also at an angle of about 90° to a horizontal plane parallel to the machine level. By inclining the impingement drying unit 10, said angle formed with the horizontal plane parallel to the machine level can be changed so that it differs from 90°, however, it is advantageous that said angle is kept below 120° on the side of impingement. To keep the detrimental effect of the force of gravity within acceptable limits, it is advantageous that said angle is selected from between 120° and 60°.

In the exemplifying embodiment shown in FIG. 3, in the impingement drying unit 10 there are two impingement devices 101 on the vertical run sections 21 and 22 of the wire loop 11 such that the first impingement device 101 applies an impingement air jet directly to the surface of the web 2, which web runs as substantially straight away from the drying group R lying against the first impingement surface IP1, and such that the second impingement device 101 applies an impingement air jet directly, and not through the wire 1, to the web 2, which runs as substantially straight towards the drying group R lying against the second impingement surface IP2. It shall be noted that, in addition to the exemplifying embodiment illustrated, the invention also encompasses impingement drying units 10 and dryer sections and drying groups R provided with such units which have a different number of impingement drying units 10 or impingement surfaces IP1, IP2. The impingement drying unit 10 in accordance with the invention thus includes at least one impingement surface IP1, IP2 and at least one impingement drying device 101 acting on it.

In the exemplifying embodiment shown in FIG. 4, an impingement drying unit 10 has been disposed in connection with one drying group R applying single wire draw in a dryer section, in which drying group R the wire 1 and the web 2 supported by it meander around drying cylinders 3 and turning rolls 4 such that on the drying cylinder 3 the web 2 is against the drying cylinder 3 under the wire 1 and on the turning roll 4 the wire 1 is against the turning roll 4 under the web 2.

In the exemplifying embodiment shown in FIG. 4, the impingement drying unit 10 in accordance with the invention has been placed above the drying groups R and provided with a wire loop 11 of its own, and to keep the wire loop 11 under desired tension and tightness, a guide roll and a tensioning roll, which can be positioned in a horizontal direction, are arranged to act on the wire loop 11. The wire loop 11 of the impingement drying unit 10 is in roll contact in the direction of the machine level with turning rolls 4 of the drying groups R situated both on its left side and on its right side, in which connection, in the machine direction (MD), which in FIG. 4 is from the left to the right, the web 2 can be picked up on the inlet side of the impingement drying unit 10 from the wire of the left-hand drying group R onto the wire 1 of the impingement drying unit 10 and, on the outlet side, it can be passed from the wire 1 of the impingement drying unit 10 onto the wire of the right-hand drying group R. The first substantially straight impingement surface IP1, provided for the web 2 and placed in an upright position, and the first run section 21, which is associated therewith and which is directed away from the drying groups R, i.e. perpendicularly upwards in the figure, begin from the inlet side of the impingement drying unit 10. After the first run section 21, the wire 1 of the impingement drying unit 10 runs around the auxiliary turning roll 14, after which the second substantially upright and straight impingement surface IP2 provided for the web 2 and the second run section 22, which is associated therewith and which is directed towards the drying group R, i.e. perpendicularly downwards in the figure, begin. The web 2 is passed from the wire 1 of the impingement drying unit 10 onto the wire of the drying group R and further with the wire of the drying group R onto the circumference of a turning roll, after which the wire and the web again meander together around the drying cylinders 3 and turning rolls 4 of the drying group R.

In the exemplifying embodiment of FIG. 4, the web 2 thus runs in the first run section 21 of the impingement drying unit 10 lying against the first impingement surface IP1, placed in a substantially upright position, along a substantially linear path in a direction away from the row DSR of the drying cylinders 3 and in the second run section 22 lying against the second impingement surface IP2, placed in a substantially upright position, along a substantially linear path towards the row DSR of the drying cylinders 3. To turn the running direction of the web from away from the row DSR of the drying cylinders 3 towards the row DSR of the drying cylinders 3, the impingement drying unit 10 comprises a turning device, for example, the auxiliary turning roll 14 or another auxiliary means for changing direction. Depending on the distance between the run sections 21 and 22 in the horizontal direction, two turning devices can be used, such as an auxiliary turning roll or another auxiliary means for changing direction, in which connection between the turning devices there is advantageously a horizontal blow/suction box assembly (18, cf. FIG. 7), and an additional impingement device (17, cf. FIGS. 2 & 7) can be additionally arranged between the auxiliary turning rolls or turning devices.

In the exemplifying embodiment shown in FIG. 4, the first impingement surface IP1 directed away from the row DSR of the drying cylinders 3 and placed in a substantially upright position as well as the first run section 21 associated therewith and the second impingement surface IP2 directed towards the row DSR of the drying cylinders 3 and placed in a substantially upright position as well as the second run section 22 associated therewith form, on the side of impingement, an angle of about 90° with a horizontal plane parallel to the machine level. Most advantageously, the impingement surfaces IP1 and IP2 are also situated symmetrically on both sides of the centre-line K of the impingement drying unit 10, i.e. the symmetry line of the impingement surfaces IP1, IP2, in which connection the centre-line or the symmetry line of the impingement surfaces is also at an angle of about 90° to a horizontal plane parallel to the machine level. By inclining the impingement drying unit 10, said angle formed with the horizontal plane parallel to the machine level can be changed so that it differs from 90°, however, with a view to minimising the detrimental effect of the force of gravity, it is beneficial to avoid inclining the impingement drying unit 10 too much, that is, it is beneficial to attempt to keep said angle in a range of 120°–60° on the side of impingement.

In the exemplifying embodiment shown in FIG. 4, in the impingement drying unit 10 there are two impingement drying devices 101 on the vertical run sections 21, 22 of the wire loop 11 such that the first impingement device 101 applies an impingement air jet directly to the surface of the web 2, which web runs as substantially straight lying against the first impingement surface IP1, placed in a substantially upright position, in a direction away from the row DSR of the drying cylinders 3, and such that the second impingement device 101 applies an impingement air jet directly to the surface of the web 2, which web runs as substantially straight lying against the second impingement surface IP2, placed in a substantially upright position, towards the row DSR of the drying cylinders 3.

It shall be noted that, in addition to the exemplifying embodiment illustrated, the invention also encompasses impingement drying units 10 and dryer sections and drying groups provided with such units which have a different number of impingement drying units 10 or impingement devices 101 or impingement surfaces IP1, IP2. The impingement drying unit 10 in accordance with the invention thus includes at least one impingement surface IP1, IP2 and at least one impingement drying device 101 acting on it.

In the second exemplifying embodiment of the invention shown in FIG. 5, the impingement drying unit 10 has been disposed in connection with one drying group R applying single-wire draw in a dryer section, so that the impingement drying unit 10 extends from inside the drying group R below a horizontal plane which is parallel to the machine level and passes through the lowermost drying cylinders of the drying group R, i.e. below the lowermost drying cylinders, and the wire loop 11 is formed of the wire 1 of the drying group R. In this exemplifying embodiment shown in FIG. 5, the impingement drying unit 10 placed in an upright position has been disposed in the place of the first turning roll 4 of the drying group R. The wire 2 comes from the first drying cylinder 3 of the drying group R applying single-wire draw downwards to the inlet side of the impingement drying unit 10, from which the first impingement surface IP1 provided for the web 2 and directed away from the drying group R, i.e. downwards in FIG. 5, and the substantially straight first run section 21 associated therewith begin. After the first impingement surface IP1, the wire 1 runs around the auxiliary turning roll 14, after which the second impingement surface IP2 provided for the web 2 and directed towards the drying group R, i.e. upwards in FIG. 2, and the second substantially straight run section 22 associated therewith begin. After the second impingement surface IP2, the wire 1 returns from the outlet side of the impingement drying unit 10 to the second drying cylinder 3 of the drying group R. After the impingement drying unit 10, the wire 1 and the web 2 meander together around the other drying cylinders 3 and turning rolls 4 of the drying group.

Thus, in the exemplifying embodiment shown in FIG. 5, in the first run section 21 of the impingement drying unit 10, the web 2 runs against the first impingement surface IP1 as substantially straight in a direction away from the drying group R and, after that, in the second run section 22, against the second impingement surface IP2 as substantially straight towards the drying group R. To turn the run of the web 2 away so as to be directed towards the drying group R, the impingement drying unit 10 is provided with a turning device which is formed of the auxiliary turning roll 14 or another auxiliary means for changing direction. Alternatively, the single auxiliary turning roll 14 can be replaced with two auxiliary turning rolls 141 and 142, as illustrated by an interrupted line in FIG. 5. Depending on the distance between the first and the second substantially upright run section 21, 22 in the horizontal direction, an additional impingement device (17, cf. FIGS. 3 & 4) can be disposed in the run section 23 of the web run between the auxiliary turning rolls 141, 142, which run section is substantially horizontal, i.e. horizontal or obliquely ascending or obliquely descending. Also, the normal turning roll 4 of the drying group can be replaced, when needed, with two smaller-diameter guide rolls of the web 2 to guide the run of the web 2 and the wire 1 from the drying cylinder 3 to the impingement drying unit 10 and vice versa.

In the exemplifying embodiment of FIG. 5, the first impingement surface IP1 directed away from the drying group R, placed in a substantially upright position and defined by the outer surface of the wire 1, and the first run section 21 as well as the second impingement surface IP2 directed towards the drying group R, placed in a substantially upright position and defined by the outer surface of the wire 1, and the second run section 22 are substantially parallel and advantageously form, on the side of impingement, an angle of about 90° with a horizontal plane parallel to the machine level. In that connection, it is also advantageous that the impingement surfaces IP1 and IP2 as well as the run sections 21 and 22 are situated symmetrically on both sides of the centre-line K of the impingement drying unit 10, i.e. the symmetry line of the impingement surfaces, in which connection the centre-line K of the impingement drying unit 10 or the symmetry line of the impingement surfaces IP1 and IP2 is also at said angle of about 90° to a horizontal plane parallel to the machine level. By inclining the impingement drying unit 10, said angle formed with the horizontal plane parallel to the machine level can be changed so that it differs from said about 90°, however, it is advantageous that said angle is kept below 120° on the side of impingement and, in particular to minimise the detrimental effect of the force of gravity, advantageously in a range of 120°–60°.

In the exemplifying embodiment shown in FIG. 5, in the impingement drying unit 10 there are two impingement devices 101 on the vertical run sections 21, 22 of the wire loop 11 such that the first impingement device 101 applies an impingement air jet directly to the web 2, which runs as substantially straight in a direction away from the drying group R lying against the first impingement surface IP1 and along the run section 21, and such that the second impingement device 101 applies an impingement air jet directly to the web 2, which runs as substantially straight towards the drying group R lying against the second impingement surface IP2 along the second run section 22. It shall be noted that, in addition to the exemplifying embodiment illustrated, the invention also encompasses impingement drying units 10 and dryer sections and drying groups R provided with such units which have a different number of impingement drying devices 101 or impingement surfaces IP1, IP2. The impingement drying unit 10 in accordance with the invention thus includes at least one impingement surface and at least one impingement drying device acting on it.

FIG. 6 shows the third advantageous exemplifying embodiment of the present invention, the essential difference of which with respect to the first exemplifying embodiment is the different shape of the first impingement surface IP1 placed in a substantially upright position and the second impingement surface IP2 placed in a substantially upright position as well as of the first and second run sections 21, 22 associated therewith in the impingement drying unit 10.

It shall be noted that, in addition to the general shape of the side profiles of the impingement surfaces IP1, IP2 which is changeably curved in its radius of curvature, the impingement surface IP1, IP2 can be formed of successive substantially straight and/or curved parts which are at a selectable angle to one another, in which connection the shape of the side profile of the impingement surface IP1, IP2 is in the shape of a broken line.

In the third exemplifying embodiment of the invention shown in FIG. 6, the impingement drying unit 10 has been disposed in connection with one drying group R applying single-wire draw in a dryer section, in which drying group the wire 1 and the web 2 supported by it meander around drying cylinders 3 and turning rolls 4 such that on the drying cylinder 3 the web 2 is against the drying cylinder 3 under the wire 1 and on the turning roll 4 the wire 1 is against the turning roll 4 under the web 2.

In the exemplifying embodiment of FIG. 6, the impingement drying unit 10 has been placed below the drying group R in the machine direction, which in FIG. 2 is from the left to the right, directly beneath a turning roll 4 and the wire loop 11 is formed of the wire 1 of the drying group R. As shown in FIG. 6, the wire 1 comes together with the web 2 from a drying cylinder 3 of the drying group R applying single-wire draw to the circumference of the turning roll 4 of the drying group, from which the web 2 and the wire 1 move to the impingement drying unit 10, from the beginning of which the first impingement surface IP1 provided for the web 2, directed away from the row DSR of the drying cylinders 3, i.e. downwards in the figure, and placed in a substantially upright position, and the first run section 211 associated therewith begin, the side profiles of said impingement surface and run section being in this second exemplifying embodiment of the invention changeably curved in their radius of curvature. After the first impingement surface IP1, the wire 1 runs around the auxiliary turning roll 14, after which the second impingement surface IP2 provided for the web 2 and situated in a substantially upright position and the second run section 221 associated therewith begin, said impingement surface and run section also having curved side profiles. After the second impingement surface IP2, the wire 1 returns from the outlet side of the impingement drying unit 10 to the circumference of the turning cylinder 4.

In the exemplifying embodiment shown in FIG. 6, the web 2 thus runs in the impingement drying unit 10 first lying against the first impingement surface IP1 in the curved first run section 211 in a direction away from the row DSR of the drying cylinders 3 and, after that, lying against the second impingement surface IP2 in the curved second run section 221 towards the row DSR of the drying cylinders 3. To turn the running direction of the web from away from the row DSR of the drying cylinders 3 towards the row DSR of the drying cylinders 3, the impingement drying unit 10 comprises an auxiliary turning roll 14 or auxiliary turning rolls 141, 141, as illustrated by an interrupted line in FIG. 5, or another means for changing direction. Depending on the distance between the run sections 211, 221 in the horizontal direction, it is possible to use a horizontal blow/suction box assembly 18 between the auxiliary turning rolls 141, 141 or other turning devices, in which connection a horizontal additional impingement device (17, cf. FIGS. 2 & 7) can be provided between the auxiliary turning rolls or turning devices.

In this second exemplifying embodiment of the invention, the first impingement surface IP1 directed away from the row DSR of the drying cylinders 3 as well as the first run section 211 associated therewith and/or the second impingement surface IP2 directed towards the row DSR of the drying cylinders 3 as well as the second run section 221 associated therewith form, on the side of impingement, as shown in FIG. 6, advantageously an angle of about 90° with a horizontal plane parallel to the machine level. Most advantageously, the impingement surfaces IP1 and IP2 are additionally situated symmetrically on both sides of the centre-line K of the impingement drying unit 10, i.e. the symmetry line of the impingement surfaces, in which connection the centre-line K or the symmetry line of the impingement surfaces also forms said angle of about 90° with a horizontal plane parallel to the machine level. By inclining the impingement drying unit 10, said angle formed with the horizontal plane parallel to the machine level can be changed so that it differs from 90°, however, it is beneficial to keep said angle ≦1200 on the side of impingement and, to keep the excessively detrimental effect of the force of gravity within acceptable limits, in a range of 120°–60°. When the impingement drying unit 10 is a unit situated beneath the row DSR of the drying cylinders, said angle is advantageously in a range of 90°–60°, in which connection the detrimental effect of the force of gravity is substantially prevented.

In the exemplifying embodiment of FIG. 6, in the impingement drying unit 10 there are two impingement drying devices 102 on the first and second impingement surfaces IP1 and IP2 of the wire loop 11 such that the first impingement device 102 applies an impingement air jet to the surface of the web 2, which web runs along the curved run section 211 of the first impingement surface IP1 in a direction away from the row DSR of the drying cylinders 3, and the second impingement device 102 applies an impingement air jet to the surface of the web 2, which web runs along the curved run section 221 of the second impingement surface aIP2 towards the row DSR of the drying cylinders 3.

It shall be noted that, in addition to the second exemplifying embodiment shown in FIG. 6, the invention also encompasses impingement drying units 10 and drying groups provided with such units which have a different number of impingement drying units 10 or impingement devices 102 or impingement surfaces IP1, IP2. The impingement drying unit 10 or a dryer section or group provided with such a unit in accordance with the invention thus includes at least one impingement surface IP1, IP2 and at least one impingement drying device 102 acting on the impingement surface IP1, IP2. Also, the scope of the invention is not confined to a curved run section only, but the run section in its entirety or a portion of it can be formed of several successive straight parts, in which connection the side profile of the run section is substantially in the shape of a broken line. It shall also be emphasised that the impingement drying unit may also comprise only one impingement surface provided with air impingement, the shape of the side profile of which impingement surface can be curved or a broken line or a selectable combination of these and a straight run section part, in which connection the upright position means that, on the side of air impingement, a line passing via the beginning and the end of the run section forms an angle with a horizontal plane parallel to the machine level, which angle in accordance with the invention is ≦120°, advantageously in a range of 120°–60° to prevent the excessively detrimental of the force of gravity. Particularly advantageously, the angle formed with the horizontal plane parallel to the machine level is, however, about 90° in accordance with the invention. Moreover, it is advantageous in accordance with the invention that the impingement surfaces IP1 and IP2 symmetrically on both sides of the centre-line K of the impingement drying unit 10, i.e. the symmetry line of the impingement surfaces, in which connection the centre-line K or the symmetry line of the impingement surfaces also forms said angle of about 90° with a horizontal plane parallel to the machine level. By inclining the impingement drying unit 10, said angle formed with the horizontal plane parallel to the machine level can be changed so that it differs from 90°, however, it is advantageous that said angle is kept below 120° on the side of impingement and, to prevent the excessively detrimental effect of the force of gravity, in a range of 120°–60°, in which connection the detrimental effect of the force of gravity is substantially reduced.

FIG. 7 shows the fourth advantageous exemplifying embodiment of the present invention, the essential difference of which with respect to the first exemplifying embodiment is the different shape of the first impingement surface IP1 placed in a substantially upright position and the second impingement surface IP2 placed in a substantially upright position as well as of the first and second run sections 212, 222 associated therewith in the impingement drying unit 10. In this third exemplifying embodiment of the invention, the first impingement surface IP1 and the second impingement surface IP2 converge symmetrically on both sides of the centre-line K of the impingement drying unit 10 towards the row DSR of drying cylinders 3. It shall be noted that, in addition to the generally straight general shape of the impingement surfaces IP1, IP2, the impingement surface IP1, IP2 can also be changeably curved in its radius of curvature over part of its length or formed of successive substantially straight parts which are at an angle to one another. In that case, in a corresponding manner, part of the length of the impingement surface IP1, IP2 is, when viewed from the side, curved in shape or it is in the shape of a broken line. In that connection, the upright position in accordance with the invention means that on the side of impingement the line between the beginning and the end of the impingement surface IP1, IP2 forms an angle with a horizontal plane parallel to the machine level, said angle being in accordance with the invention ≦120°, advantageously in a range of 120°–60° and particularly advantageously about 90°.

In the fourth exemplifying embodiment of the invention shown in FIG. 7, the impingement drying unit 10 has been disposed in connection with one drying group R applying single-wire draw in the dryer section, below the row DSR of the drying cylinders 3. In single-wire draw, the wire 1 and the web 2 supported by it meander around the drying cylinders 3 and the turning rolls 4 such that on the drying cylinder 3 the web 2 is against the drying cylinder 3 under the wire 1 and on the turning roll the wire 1 is against the turning roll 4 under the web 2.

In the fourth exemplifying embodiment of the invention shown in FIG. 7, the impingement drying unit 10 in accordance with the invention has been placed beneath the first turning roll 4 of the horizontal drying group R situated in the machine direction (MD) parallel to the machine level, which machine direction in FIG. 6 is from the left to the right, and the wire loop 11 is formed of the wire 1 of the drying group R. As shown in FIG. 6, the wire 1 onto which the web 2 is passed from the wire of the preceding drying group R applying single-wire draw, comes together with the web 2 from the turning roll 4 to the inlet side of the impingement drying unit 103, from which the first impingement surface IP provided for the web 2 and placed in a substantially upright position as well as the first run section 212 associated therewith begin. In this fourth exemplifying embodiment of the invention, the first impingement surface IP1, along whose run section 212 the web 2 runs in a direction away, i.e. downwards in the figure, from the row DSR of the drying cylinders 3, forms, on the side on impingement, an angle with a horizontal plane parallel to the machine level, said angle being about 75° on the side of impingement. After the first run section 212, the wire 1 runs around the first auxiliary turning roll 141, after which there is provided for the web 2 a substantially horizontal run section 23 which ends at the second auxiliary turning roll 142, from which the second impingement surface IP provided for the web 2 and the associated second run section 222 begin. On this second impingement surface IP2, the web 2 runs along the second run section 222 towards the row DSR of the drying cylinders 3, i.e. upwards in the figure, and the second impingement surface forms, on the side of impingement, an angle with a horizontal plane parallel to the machine level, said angle being about 75° on the side of impingement. After the second run section 222, the web 2 and the wire 1 return from the outlet side of the impingement drying unit 10 over the circumference of the turning cylinder 4 again to the drying cylinder 3. Without detriment to the run of the web 2 and/or the wire 1 in the impingement drying unit 10 and to prevent the excessively detrimental effect of the force of gravity, it is most preferable that said angle is selected from a range of 120°–60° and, when the impingement drying unit 10 is a unit placed under the drying cylinder row DSR, it is advantageous that said angle is selected from a range of 120°–60° to substantially prevent the detrimental effect of the force of gravity.

In the fourth exemplifying embodiment of the invention shown in FIG. 7, the web 2 thus runs in the impingement drying unit 10 along a substantially triangular path, first along the run section 212 of the first impingement surface IP1 at an angle of about 75° on the side of impingement in a direction away from the row DSR of the drying cylinders 3, then in a substantially horizontal direction along the substantially horizontal run section 23, and finally along the run section 222 of the second impingement surface IP2 at an angle of about 75° on the side of impingement towards the row DSR of the drying cylinders 3. Thus, the first and the second impingement surface IP1 and IP2 converge symmetrically towards the row DSR of the drying cylinders 3. To turn the run of the web 2 from one orientation directed away from the row DSR of the drying cylinders 3 at an angle deviating from a right angle to another angle deviating from a right angle, in which orientation the web runs towards the row DSR of the drying cylinders 3, this impingement drying unit 10 in accordance with this fourth exemplifying embodiment of the invention comprises two auxiliary turning rolls 141 and 142 or other auxiliary means for changing direction, which rolls or means are spaced from each other. When the auxiliary turning rolls 141 and 142 or other turning devices are spaced from each other, a substantially horizontal, i.e. horizontal or obliquely ascending or obliquely descending run section 23 is formed in said spacing. To support the web 2 in this substantially horizontal run section 23, it is beneficial to use support rolls or, as shown in FIG. 7, a blow/suction box assembly 18 and an additional impingement device 17 which acts directly on the surface of the web 2, which runs in this substantially horizontal run section 23 lying against the substantially straight additional impingement surface AIP defined by the outer surface of the wire 1.

In the fourth exemplifying embodiment of the invention shown in FIG. 7, the first impingement surface IP1 directed obliquely downwards, i.e. in a direction away from the row DSR of the drying cylinders 3, and the associated first run section 212 as well as the second impingement surface IP2 directed obliquely upwards, i.e. towards the row DSR of the drying cylinders 3, and the associated second run section 222 are both on the side of impingement at an angle of about 75° to a horizontal plane parallel to the machine level. In that case, the impingement surfaces IP1 and IP2 are situated symmetrically on both sides of the centre-line K of the impingement drying unit 10, i.e. the symmetry line of the impingement surfaces, the centre-line K being at an angle of about 90° to the horizontal plane parallel to the machine level. By inclining the impingement drying unit 10, said angle formed with the horizontal plane parallel to the machine level can be changed so that it differs from 90°; however, it is beneficial to keep the change of said angle as small as possible, to minimise the detrimental effect of the force of gravity, i.e. keep the angle between the impingement surfaces and the horizontal plane parallel to the machine level in a range of 120°–60°. When the impingement drying unit 10 is a unit placed under the drying cylinder row DSR, said angle is in a range of 90°–60° to substantially prevent the detrimental effect of the force of gravity.

In the exemplifying embodiment of FIG. 7, in the impingement drying unit 10 there are two impingement drying devices 103 on the first and second impingement surfaces IP1 and IP2 of the wire loop 111 such that the first impingement device 103 applies an impingement air jet directly to the surface of the web 2, which web runs as substantially straight against the run section 212 of the first impingement surface IP1, placed in a substantially upright position, in a direction away from the row DSR of the drying cylinders 3 at an angle of about 75°, and such that the second impingement device 103 applies an impingement air jet directly to the surface of the web 2, which web runs as substantially straight against the run section 222 of the second impingement surface IP2, placed in a substantially upright position, towards the row DSR of the drying cylinders 3 at an angle of about 75°. In addition, as shown in FIG. 7, the impingement drying unit advantageously includes an additional impingement device 17, which acts on the surface of the web 2 which is against the substantially horizontal, i.e. horizontal or obliquely ascending or obliquely descending additional impingement surface AIP. In this impingement drying unit 10 in accordance with the fourth exemplifying embodiment of the invention, the first impingement air jet is applied directly to the surface of the web 2, which web runs in a direction away, i.e. downwards in FIG. 7, from the row DSR of the drying cylinders 3 along the first run section 212 and against the first impingement surface IP1, and the second impingement air jet is also applied directly to the surface of the web 2, which runs towards the row DSR of the drying cylinders 3, i.e. upwards in FIG. 7, along the second run section 222 and against the second impingement surface IP2. It shall be noted that, in addition to the exemplifying embodiment illustrated, the invention also encompasses impingement drying units 10 and dryer sections and drying groups R having a different number of impingement surfaces IP1, IP2 and impingement drying units 103 acting on them. Thus, the impingement drying unit 10 or the dryer section or the drying group R in accordance with the invention includes at least one impingement surface IP1, IP2 and at least one impingement drying device 103 acting on the impingement surface.

FIG. 8 shows the fifth advantageous exemplifying embodiment of the present invention, the essential difference of which with respect to the fourth exemplifying embodiment described above is the different shape of the first impingement surface IP1 placed in a substantially upright position and the second impingement surface IP2 placed in a substantially upright position as well as of their first and second run sections 212, 222 in the impingement drying unit 10. In this fifth exemplifying embodiment of the invention, on the side of impingement, the angle between the first impingement surface IP1 and the horizontal plane parallel to the machine level is different from the angle between the second impingement surface IP2 and the horizontal plane parallel to the machine level and, in addition, the centre-line K of the impingement drying unit 10, which centre-line K is formed of the centre-line of the lines passing via the beginnings and the ends of the impingement surfaces IP1 and IP2, i.e. in the vertical direction of the impingement drying unit 10, the impingement surfaces IP1 and IP2 are over their entire length at the same distance from the centre-line K and thus converge symmetrically towards the drying cylinder row DSR, is at a different angle from the angle between the first or the second impingement surface IP1, IP2 and the horizontal plane parallel to the machine level. converging asymmetrically on both sides of the centre-line K of the impingement drying unit 10 towards the row DSR of the drying cylinders 3.

It shall be noted that in addition to the generally straight shape of the impingement surfaces IP1, IP2 shown in FIG. 8, the impingement surface IP1, IP2 can also be changeably curved in its radius of curvature over part of its length or formed of successive substantially straight parts which are at an angle to one another. In that case, in a corresponding manner, part of the length of the side profile of the impingement surface IP1, IP2 can be curved or in the shape of a broken line or a selectable combination of these. It shall also be noted that the impingement surfaces can converge as asymmetrical in shape or in position towards the drying cylinder row DSR. In that connection, the upright position in accordance with the invention means that on the side of impingement the impingement surface or the line between the beginning and the end of the impingement surface IP1, IP2 forms, on the side of impingement, an angle with a horizontal plane parallel to the machine level, said angle being in accordance with the invention ≦120°, the angle being advantageously in a range of 120°–60° and particularly advantageously about 90°.

In the fifth exemplifying embodiment of the invention shown in FIG. 8, the impingement drying unit 10 has been disposed in connection with one drying group R applying single-wire draw in the dryer section, below the row DSR of the drying cylinders 3. In single-wire draw, the wire 1 and the web 2 supported by it meander around the drying cylinders 3 and the turning rolls 4 such that on the drying cylinder 3 the web 2 is against the drying cylinder 3 under the wire 1 and on the turning roll the wire 1 is against the turning roll 4 under the web 2.

In the fourth exemplifying embodiment of the invention shown in FIG. 8, the impingement drying unit 10 in accordance with the invention has been placed beneath the first turning roll 4 of the horizontal drying group R situated in the machine direction (MD) parallel to the machine level, which machine direction in FIG. 6 is from the left to the right, and the wire loop 11 is formed of the wire 1 of the drying group R. As shown in FIG. 8, the wire 1 onto which the web 2 is passed from the wire of the preceding drying group R applying single-wire draw, comes together with the web 2 from the turning roll 4 to the inlet side of the impingement drying unit 103, from which the first impingement surface IP provided for the web 2 and placed in a substantially upright position as well as the first run section 212 associated therewith begin. In this fifth exemplifying embodiment of the invention, the first impingement surface IP1, along whose run section 212 the web 2 runs in a direction away, i.e. downwards in the figure, from the row DSR of the drying cylinders 3, forms, on the side on impingement, an angle with a horizontal plane parallel to the machine level, said angle being about 100° on the side of impingement. After the first run section 212, the wire 1 runs around the first auxiliary turning roll 141, after which there is provided for the web 2 a substantially horizontal run section 23 which ends at the second auxiliary turning roll 142, from which the second impingement surface IP provided for the web 2 and the associated second run section 222 begin. On this second impingement surface IP2, the web 2 runs along the second run section 222 towards the row DSR of the drying cylinders 3, i.e. upwards in the figure, and the second impingement surface forms, on the side of impingement, an angle with the horizontal plane parallel to the machine level, said angle being about 70° on the side of impingement. After the second run section 222, the web 2 and the wire 1 return from the outlet side of the impingement drying unit 10 over the circumference of the turning cylinder 4 again to the drying cylinder 3. Without detriment to the run of the web 2 and/or the wire 1 in the impingement drying unit 10 and to prevent the excessively detrimental effect of the force of gravity, it is most preferable that said angles are selected from a range of 120°–60°.

In the fourth exemplifying embodiment of the invention shown in FIG. 8, the web 2 thus runs in the impingement drying unit 10 along a substantially triangular path, first in the run section 212 of the first impingement surface IP1 at an angle of about 100° on the side of impingement in a direction away from the row DSR of the drying cylinders 3, then in a substantially horizontal direction in the substantially horizontal run section 23, and finally in the run section 222 of the second impingement surface IP2 at an angle of about 70° on the side of impingement towards the row DSR of the drying cylinders 3. Thus, the first and the second impingement surface IP1 and IP2 converge at different angles towards the row DSR of the drying cylinders 3. To turn the run of the web 2 from an orientation directed away from the row DSR of the drying cylinders 3 at one angle to an orientation directed towards the row DSR of the drying cylinders 3 at another angle, this impingement drying unit 10 according to the fifth exemplifying embodiment of the invention comprises two auxiliary turning rolls 141 and 142 or other auxiliary means for changing direction, which rolls or means are spaced from each other, so that the substantially horizontal, i.e. horizontal or obliquely ascending or obliquely descending run section 23 is formed between the auxiliary turning rolls 141 and 142 or other turning devices. To support the web 2 in this substantially horizontal run section 23, it is beneficial to use support rolls or, as shown in FIG. 8, a blow/suction box assembly 18 and an additional impingement device 17 which acts directly on the surface of the web 2, which runs in this substantially horizontal run section 23 against the substantially straight additional impingement surface AIP defined by the outer surface of the wire 1.

In the fifth exemplifying embodiment of the invention shown in FIG. 8, the first impingement surface IP1 directed away from the row DSR of the drying cylinders 3, for example, at said angle of about 100° as well as the associated first run section 212 and the second impingement surface IP2 directed towards the row DSR of the drying cylinders 3, for example, at said angle of about 70° as well as the associated second run section 222 are both, in the vertical direction of the impingement drying unit 10, at the same distance from the centre-line K of the impingement drying unit, which centre-line K forms on the side of impingement of the first impingement surface IP1 a larger angle with the horizontal plane parallel to the machine level than the angle which is correspondingly formed by the first impingement surface IP1 with the horizontal plane parallel to the machine level. In the exemplifying embodiment shown in FIG. 7, said angle formed with the horizontal plane parallel to the machine level is about 105° on the side of impingement of the first impingement surface IP1. Since the impingement surfaces IP1 and IP2 are at the same distance from the centre-line K of the impingement drying unit, they are thus also symmetrically positioned on both sides of the centre-line K of the impingement drying unit 10, i.e. the symmetry line of the impingement surfaces. By inclining the impingement drying unit 10, said angle of the centre-line K formed with the horizontal plane parallel to the machine level on the side of impingement of the first impingement surface IP1 can be changed, however, it is advantageous that said angle is kept, to keep the detrimental effect of the force of gravity within certain limits, i.e. advantageously in a range of 120°–60°. When the impingement drying unit 10 is a unit placed under the drying cylinder row DSR, depending on the direction of inclination, to substantially prevent the detrimental effect of the force of gravity, the angle between the first impingement surface IP1 or a tangent to the impingement surface or the centre-line K of the impingement drying unit 10 and the horizontal plane parallel to the machine level is in a range of 120°–90° on the side of impingement.

In the exemplifying embodiment of FIG. 8, in the impingement drying unit 10 there are two impingement drying devices 103 on the first and second impingement surfaces IP1 and IP2 of the wire loop 111 such that the first impingement device 103 applies an impingement air jet directly to the surface of the web 2, which web runs as substantially straight against the run section 212 of the first impingement surface IP1, placed in a substantially upright position, in a direction away from the row DSR of the drying cylinders 3 at an angle of about 100°, which is formed on the side of impingement between the first impingement surface IP1 and the horizontal plane parallel to the machine level, and such that the second impingement device 103 applies an impingement air jet to the surface of the web 2, which web runs as substantially straight against the run section 222 of the second impingement surface IP2, placed in a substantially upright position, towards the row DSR of the drying cylinders 3 as substantially straight at an angle of about 75°, which is formed on the side of impingement between the second impingement surface IP2 and the horizontal plane parallel to the machine level. In addition, as shown in FIG. 8, the impingement drying unit advantageously includes an additional impingement device 17, which acts on the surface of the web 2 which is against the substantially horizontal, i.e. horizontal or obliquely ascending or obliquely descending additional impingement surface AIP. In this impingement drying unit 10 in accordance with the fifth exemplifying embodiment of the invention, the first impingement air jet is thus applied to the surface of the web 2, which web runs in a direction away from the row DSR of the drying cylinders 3 along the first run section 212 and against the first impingement surface IP1, and the second impingement air jet is also applied to the surface of the web 2, which web runs towards the row DSR of the drying cylinders 3 along the second run section 222 and against the second impingement surface IP2.

In the second exemplifying embodiment shown in FIG. 9, an impingement drying unit 10 has been disposed in connection with one drying group R applying single wire draw in a dryer section, in which drying group R the wire 1 and the web 2 supported by it meander around drying cylinders 3 and turning rolls 4, which are arranged in a vertical position with respect to the machine level, such that on the drying cylinder 3 the web 2 is against the drying cylinder 3 under the wire 1 and on the turning roll 4 the wire 1 is against the turning roll 4 under the web 2. It must be emphasised that the number of the drying cylinders 3 and the turning rolls 4 is selectable and may even considerably differ from the two drying cylinders and the two turning rolls illustrated as an example in FIG. 9.

In the exemplifying embodiment shown in FIG. 9, the impingement drying unit 10 in accordance with the invention has been placed above the drying groups R and provided with a wire loop 11 which it shares with the drying cylinders 3 and the turning rolls 4. The wire loop 11 of the impingement drying unit 10 is in roll contact in the direction of the machine level both with a turning roll 4 of the drying group R on its left side, in which connection, in the machine direction (MD), the web 2 can be picked up on the inlet side of the impingement drying unit 10 from the wire of the left-hand drying group R onto the wire of the impingement drying unit 10. On the outlet side of the drying group comprising the impingement unit 10, the web 2 can be transferred from the wire 1 onto a wire of the right-hand drying group R (not shown in FIG. 9) or to the next stage in the direction of treatment of the web 2. The first substantially straight impingement surface IP1, provided for the web 2 and placed in an upright position, and the first run section 21, which is associated therewith and which is directed away from the turning roll 4 of the preceding drying group R, i.e. perpendicularly upwards in the figure, begin on the inlet side of the impingement drying unit 10. After the first run section 21, the wire 1 of the impingement drying unit 10 runs first around the first auxiliary turning roll 141 and then around the second auxiliary turning roll 142, after which the second substantially upright and straight impingement surface IP2 provided for the web 2 and the second run section 22 associated therewith and directed towards the group placed in an upright position and formed by the turning rolls 4 and the drying cylinders 3, i.e. perpendicularly downwards in the figure, begin. After the drying group comprising the impingement drying unit 10, the wire 1 and the web 2 again meander together around possible other groups formed by drying cylinders 3 and turning rolls 4 of the drying group R and placed in an upright or horizontal position with respect to the machine level.

In the exemplifying embodiment of FIG. 9, the web 2 thus runs in the first run section 21 of the impingement drying unit 10 lying against the first impingement surface IP1, placed in a substantially upright position, along a substantially linear path in a direction away from the row DSR of the drying cylinders 3 and in the second run section 22 lying against the second impingement surface IP2, placed in a substantially upright position, along a substantially linear path towards the row DSR of the drying cylinders 3. To turn the running direction of the web from away from the row DSR of the drying cylinders 3 towards the row DSR of the drying cylinders 3, the impingement drying unit 10 comprises a turning device. Depending on the distance between the run sections 21 and 22 in the horizontal plane parallel to the machine level, two turning devices can be used, such as auxiliary turning rolls or other auxiliary means for changing direction. In that connection, it is advantageous that between the turning devices there is a blow/suction box assembly (18, cf. FIG. 7) which is horizontal with respect to the machine level, and an additional impingement device (17, cf. FIGS. 2 & 7) can be additionally arranged between the auxiliary turning rolls or turning devices.

In the exemplifying embodiment shown in FIG. 9, the first impingement surface IP1 directed away from the row DSR of the drying cylinders 3 and placed in a substantially upright position as well as the first run section 21 associated therewith and the second impingement surface IP2 directed towards the row DSR of the drying cylinders 3 and placed in a substantially upright position as well as the second run section 22 associated therewith form, on the side of impingement, an angle of about 90° with a horizontal plane parallel to the machine level. Most advantageously, the impingement surfaces IP1 and IP2 are also situated symmetrically on both sides of the centre-line K of the impingement drying unit 10, i.e. the symmetry line of the impingement surfaces IP1, IP2, in which connection the centre-line or the symmetry line of the impingement surfaces is also at an angle of about 90° to a horizontal plane parallel to the machine level. By inclining the impingement drying unit 10, said angle formed with the horizontal plane parallel to the machine level can be changed so that it differs from 90°, however, with a view to minimising the detrimental effect of the force of gravity, it is beneficial to avoid inclining the impingement drying unit 10 too much, that is, it is beneficial to attempt to keep said angle in a range of 120°–60° on the side of impingement.

In the exemplifying embodiment shown in FIG. 9, in the impingement drying unit 10 there are two impingement drying devices 101 on the vertical run sections 21, 22 of the wire loop 11 such that the first impingement device 101 applies an impingement air jet directly to the surface of the web 2, which web runs as substantially straight lying against the first impingement surface IP1, placed in a substantially upright position, in a direction away from the row DSR of the drying cylinders 3, and such that the second impingement device 101 applies an impingement air jet directly to the surface of the web 2, which web runs as substantially straight lying against the second impingement surface IP2, placed in a substantially upright position, towards the row DSR of the drying cylinders 3.

It shall be noted that, in addition to the exemplifying embodiment illustrated, the invention also encompasses impingement drying units 10 and dryer sections and drying groups provided with such units which have a different number of impingement drying units 10 or impingement devices 101 or impingement surfaces IP1, IP2. The impingement drying unit 10 in accordance with the invention thus includes at least one impingement surface IP1, IP2 and at least one impingement drying device 101 acting on it.

It shall be noted that, in addition to the exemplifying embodiments illustrated, the invention also encompasses impingement drying units 10 and dryer sections and drying groups R the impingement surface or surfaces IP1, IP2 of which is/are located substantially totally above or below a row DSR of drying cylinders 3, in which the impingement drying unit 10 extends at least partly above and/or below a row DSR of drying cylinders 3, in which the impingement drying unit 10 extends above a line passing through the uppermost drying cylinder/cylinders 3 of a dryer section or a drying group R, which line is advantageously parallel to the horizontal plane parallel to the machine level, or, in a corresponding manner, below a line passing through the lowermost drying cylinder/cylinders 3, which line is advantageously parallel to the horizontal plane parallel to the machine level, at least partly below and/or above a drying cylinder row DSR passing through some of the drying cylinders in a drying group, which has a different number of impingement surfaces IP1, IP2 and impingement drying units 103 acting on them.

Thus, the impingement drying unit 10 or the dryer section or the drying group R in accordance with the invention includes at least one impingement surface IP1, IP2 and at least one impingement drying device 103 acting on the impingement surface. As is clear from the above exemplifying embodiments of the invention, it is not essential to the impingement drying unit 10 in accordance with the present invention what kind of drying group R it is associated with. In other words, the drying group R can be a group that applies single-wire draw or twin-wire draw. The impingement drying unit 10 in accordance with the invention can constitute a part of the drying group R of a dryer section, in which connection they advantageously have a common wire 1. In that case, the impingement drying unit 10 in accordance with the invention can be situated below and/or above the row DSR of the drying cylinders 3 parallel to the machine level.

An impingement drying unit 10 of the invention in connection with successive drying groups R can be located or extend in the machine direction in one drying group below a row DSR of drying cylinders 3 and in the next drying group it can be located or extend above a row DSR of drying cylinders 3 and in a drying group R situated after that it can again be located or extend below the row DSR of drying cylinders 3. In that connection, from the point of view of drying capacity, it is advantageous that the drying groups R are drying groups R inverted with respect to one another, so that the web 2 may be dried by air impingement from one side by means of successive impingement drying units 10 in accordance with the invention, which units 10 are situated above and below the row DSR of drying cylinders 3, respectively. Of course, several impingement drying units in accordance with the invention can be disposed to form a part of a single drying group R, which impingement drying units are then arranged to be located or extend either all above or below a row DSR of drying cylinders 3 or alternately above and below a row DSR of drying cylinders 3. When several impingement drying units 10 are arranged to form a part of one drying group R, and if the successive impingement drying units 10 are placed or arranged to extend alternately above and below a row DSR of drying cylinders 3, or some of the impingement drying units 10 are placed or arranged to extend below a row DSR of drying cylinders 3 and the other impingement drying units are placed or arranged to extend above a row DSR of drying cylinders 3, the web 2 can be dried from its both sides, thereby reducing curl of the web in a cross direction transverse to the machine direction parallel to the machine level.

The impingement drying unit 10 in accordance with the invention can also be a totally independent unit which is provided with its own wire 1, in which connection the impingement drying unit 10 can be placed in front of or behind a drying group R or between two drying groups R, positioning it or arranging it to extend below or above the drying group R.

In this description, by the centre-line K of the impingement drying unit is meant the centre-line of the perimeter of an imagined square drawn around the impingement drying unit 10 in accordance with the invention, which centre-line is at an angle of ≦120° to a horizontal plane parallel to the machine level, in the direction of which horizontal plane the cylinder drying process of the paper or board web also typically proceeds in the machine direction. In advantageous applications of the invention, the centre-line K coincides with the symmetry line between the impingement surfaces IP1, IP2 or their run sections 21, 211, 212; 22, 221, 222. Since in the impingement drying unit 10 in accordance with the invention the impingement surface IP1, IP2 or the run section 21, 211, 212; 22, 221, 222 belonging to the impingement surface or the centre or symmetry line K of the impingement drying unit 10 is perpendicular to or inclined with respect to the horizontal plane parallel to the machine level. The impingement drying unit 10 in accordance with the invention is located totally or extends at least partly below or above a row DSR of drying cylinders and is arranged at an angle with respect to the horizontal plane parallel to the machine level, which angle is ≦120°. Advantageously, said angle is in a range of 120°–60° to minimise the detrimental effect of the force of gravity. When the impingement drying unit 10 is a unit extending at least partly below a row DSR of drying cylinders, the above-mentioned angle is in a range of 90°–60° to substantially eliminate the detrimental effect of the force of gravity. When the impingement drying unit 10 is a unit extending at least partly above a row DSR of drying cylinders, the above-mentioned angle is typically about 90° to substantially eliminate the detrimental effect of the force of gravity. However, most advantageously, said angle is about 90°, i.e. a right angle, to minimise the machine direction dimension of the impingement drying, in which connection it is additionally advantageous that the run section 21, 211, 212 of the first impingement surface IP1 and the run section 22, 221, 222 of the second impingement surface IP2 in the impingement drying unit run in the same direction and symmetrically on both sides of the centre-line K or the symmetry line of the impingement surfaces.

Above, the invention has been described with reference to only some of its advantageous exemplifying embodiments to emphasise various modification and application possibilities of the invention, and the invention is not by any means meant to be confined to the exemplifying embodiments described. It may be imagined, for example, that impingement drying units and/or drying groups in accordance with the invention may also be composed such that the first run section and the second run section in the impingement drying unit are different from each other and/or in a different orientation, in which connection the side profile of the first impingement surface is straight in shape or changeably curved in its radius of curvature or in the shape of a broken line or a selectable combination of these, the side profile of the second impingement surface is straight in shape or changeably curved in its radius of curvature or in the shape of a broken line or a selectable combination of these, the first impingement surface or a line between its beginning and end is at a right angle and the second impingement surface or a line between its beginning and end is at an angle differing from the right angle to the horizontal plane parallel to the machine level or vice versa, the first impingement surface or a line between its beginning and end is at a different angle to the horizontal plane parallel to the machine level from that of the second impingement surface or a line between its beginning and end, the impingement surfaces or the lines between their beginning and end converge in shape and/or in position asymmetrically towards a row of drying cylinders, the first impingement surface or the second impingement surface is straight, changeably curved in its radius of curvature, in the shape of a broken line or a selectable combination of these or comprising two or more parts, and the second impingement surface is straight, changeably curved in its radius of curvature, in the shape of a broken line or a selectable combination of these or comprising two or more parts in a way different from the first impingement surface, or vice versa.

It shall be noted that the invention has been described above such that the impingement drying unit would comprise only one first impingement surface leading away from a row of drying cylinders as well as a first run section associated therewith and one second impingement surface leading towards a row of cylinders as well as a second run section associated therewith. Of course, the run sections can be multiplied, for example, by disposing several impingement drying units in accordance with the invention in succession in the machine direction and by arranging a turning device between the outlet and the inlet of two impingement drying units disposed one after the other, for example, an additional turning roll or a pair of them and, when desired, the impingement area can be further increased by arranging an additional impingement air jet in the substantially horizontal, i.e. horizontal or obliquely ascending or obliquely descending run section between the additional turning roll pairs.

It may be further stated that, when the space in the vertical direction is limited or it is desirable for some other reason to arrange the impingement drying unit with the other drying unit to have a lower total height without substantially compromising the drying area, the entire impingement drying unit in accordance with the invention can be inclined from a fully upright position, in which at least one impingement surface or a line passing via its beginning and end is at an angle of about 90° to the horizontal plane parallel to the machine level, to a position inclined towards the horizontal plane parallel to the machine level, in which said at least one impingement surface or the line passing via its beginning and end is at an angle to the horizontal plane parallel to the machine level, which angle is in a range of 120°–60°, in which connection the force of gravity cannot yet impede the run of the web and the wire and their adherence to the impingement surface or to the run section associated therewith. Alternatively, the impingement drying unit in accordance with the invention can be arranged to begin from inside a drying group, in which connection only a section of it extends above or below the drying group or a dryer section.

The invention claimed is:

1. An impingement drying unit for a dryer section of a machine making a fibrous web, which dryer section comprises at least one drying group and at least one impingement drying unit which extends above and/or below a row of drying cylinders and in which impingement drying unit the web is conducted past the impingement drying unit while supported by a drying fabric, the drying fabric extending between at least two vertically spaced support rolls as it is conducted past the impingement drying unit, and which impingement drying unit comprises at least one impingement surface, the side profile of which is straight, changeably curved in its radius of curvature, in the shape of a broken line or a selectable combination of these, wherein the impingement surface or a tangent to the impingement surface or a line passing via a beginning and an end of the impingement surface or an extension of said line or the centre line or the symmetry line of the impingement drying unit forms, on the impingement side, an angle with a horizontal plane parallel to the machine level, which angle is in a range of 120°–60°, in which connection the impingement surface or the impingement drying unit is in a substantially upright position, that at least one impingement drying device acts on at least one impingement surface, which is defined by the outer surface of the drying fabric running in the impingement drying unit, in which connection impingement acts directly on the web, and that the impingement drying unit is disposed to form part of the drying group or between two drying groups or after the drying groups.

2. The impingement drying unit of claim 1 wherein the impingement drying unit includes a first impingement surface and a second impingement surface, wherein the first impingement surface has a first run section which runs in a direction away from the drying group and in which the web is supported by the drying fabric from a side opposite to impingement, and wherein the second impingement surface has a second run section in which the web runs towards the drying group and in which the web is supported by the drying fabric from a side opposite to impingement.

3. The impingement drying unit of claim 2 wherein the side profile of the first and the second impingement surface is substantially: straight; curved; in the shape of a broken line formed of successive parts which are at an angle to one another; or a selectable combination of said side profile shapes.

4. The impingement drying unit of claim 1, wherein the line passing along or the tangent line to or the line passing via the beginning and the end of both the first and the second impingement surfaces is on the side of impingement at a first angle to the horizontal plane parallel to the machine level, which angle is in a range of 120°–60°.

5. The impingment drying unit of claim 4, wherein the first angle is about 90°.

6. The impingement drying unit of claim 2 wherein the first impingement surface and the second impingement surface are substantially parallel.

7. The impingement drying unit of claim 2, wherein the centre-line of the impingement drying unit coincides with a symmetry line of the impingement surfaces of the impingement drying unit.

8. The impingement drying unit of claim 1, wherein the impingement drying device is outside a loop of the drying fabric, and that means for supporting and guiding the run of the wire and the web, including support rolls, rolls and/or vacuum devices and/or suction rolls and/or blow/suction boxes attaching the web to the wire by the suction effect, are inside the wire loop on the side of the wire substantially opposite to the impingement drying device.

9. The impingement drying unit of claim 1 wherein the impingement drying device and the at least one drying group have a common wire loop, and the impingement drying unit constitutes a part of the at least one drying group.

10. The impingement drying unit of claim 1 wherein the impingement drying unit has a drying fabric of its own, which forms a wire loop, and wherein the impingement drying unit is a separate impingement drying unit which is disposed between two drying groups or in front of a drying group or after a drying group.

11. A dryer section of a machine making a fibrous web, which comprises at least one drying group applying single-wire draw or twin-wire draw and comprising at least one impingement drying unit extending above and/or below a row of drying cylinders for drying the web, and a drying fabric on whose support the web is conducted past the impingement drying unit, the drying fabric extending between at least two vertically spaced support rolls as it is conducted past the impingement drying unit, the impingement drying unit comprising at least one impingement surface, the side profile of which is straight, changeably curved in its radius of curvature, in the shape of a broken line or a selectable combination of these, wherein the impingement surface or a tangent line to the impingement surface or a line passing via a beginning and an end of the impingement surface or an extension of said line or the centre line or a symmetry line of the impingement dying unit forms, on the side of impingement, an angle with a horizontal plane parallel to a machine level, which angle is in a range of 120°–60°, in which connection the impingement surface or the impingement drying unit is in a substantially upright position, wherein at least one impingement drying device acts on at least one impingement surface, which is defined by an outer surface of the drying fabric running in the impingement drying unit, in which connection impingement acts directly on the web, and that the impingement drying unit is disposed to form part of the drying group or between two drying groups or after the dryer section.

12. The dryer section of claim 11, wherein the impingement drying unit includes a first impingement surface and a second impingement surface, that the first impingement surface includes a first run section in which the web runs in a direction away from the drying group and in which the web is supported by the drying fabric from the side opposite to impingement, and that the second impingement surface includes a second run section in which the web runs towards the drying group and in which the web is supported by the wire from the side opposite to impingement.

13. The dryer section of claim 12, wherein the side profile of the first and/or the second impingement surface is substantially: straight; curved; in the shape of a broken line formed of successive parts which are at an angle to one another; or a selectable combination of said side profile shapes.

14. The dryer section of claim 12 wherein the first and second impingement surfaces are, on the side of impingement, at least partly at a first angle with a horizontal plane parallel to the machine level, which angle is in a range of 120°–60°.

15. The dryer section of claim 14 wherein the first angle is about 90°.

16. The dryer section of claim 12, wherein the first impingement surface and the second impingement surface are substantially parallel.

17. The dryer section of claim 11, wherein the centre-line of the impingement drying unit coincides with a symmetry line of the impingement surfaces of the impingement drying unit.

18. The dryer section of claim 11 wherein the impingement drying device is outside a drying fabric loop, and that means for supporting and guiding the run of the drying fabric and the web, including support rolls and/or rolls or vacuum devices and/or suction rolls and/or blow/suction boxes attaching the web to the drying fabric by the suction effect, are inside the loop on the side of the drying fabric substantially opposite to the impingement drying device.

19. The dryer section of claim 11 wherein the impingement drying unit and the drying group have a common drying fabric to form a drying fabric loop, in which connection the impingement drying unit constitutes a part of at least one drying group of the dryer section.

20. The dryer section of claim 11, wherein the impingement drying unit is provided with a drying fabric of its own, which forms the drying fabric loop, and that the impingement drying unit is a separate impingement drying unit which is disposed between two drying groups or in front of a drying group or after a drying group.

21. The dryer section of claim 11 wherein there are several impingement drying units in the drying group or in connection with the drying group.

22. The dryer section of claim 11 wherein the impingement drying units are disposed alternately above and below a row of drying cylinders or some of the impingement drying units are disposed below a row of drying cylinders and the other impingement drying units are disposed above a row of drying cylinders, in which connection the web can be dried from both sides thereof.

23. The dryer section of claim 11 wherein there is at least one impingement drying unit in at least one drying group or in connection with at least one drying group.

24. A dryer section in a paper or board machine for making a paper or board web, the dryer section comprising:

at least a first drying group having a row of drying cylinders for drying the web, the dryer section having a horizontal plane which is parallel to a machine level;

at least one impingement drying unit extending above or below the row of drying cylinders, the impingement drying unit having at least one impingement drying device which has at least one impingement surface extending between at least two vertically spaced support rolls, wherein the impingement surface defines a first angle with a horizontal plane parallel to the machine level, which angle is in a range of 120°–60°; and a drying fabric on whose support the web is conducted past the at least one impingement drying device impingement surface, such that impingement acts directly on the web.

25. The dryer section of claim 24, wherein the side profile of the impingement surface is straight, changeably curved in its radius of curvature, in the shape of a broken line or a selectable combination of these.

26. The dryer section of claim 24 further comprising a second drying group, and wherein the impingement drying unit is disposed between the first drying group and the second drying group.

27. The dryer section of claim 24 wherein the drying unit forms a part of the first drying group.

28. The dryer section of claim 24 wherein the drying unit is positioned after the first dryer group.

29. The dryer section of claim 24 wherein the first angle is about 90°.

30. The dryer section of claim 24 wherein the impingement drying unit includes a first impingement surface and a second impingement surface, and wherein the drying fabric runs first past the first impingement surface in a direction away from the drying group, and then past the second impingement surface in a direction towards the drying group, the web being supported on the drying fabric from a side opposite to impingement.

* * * * *

UNITED STATES PATENT AND TRADEMARK OFFICE

CERTIFICATE OF CORRECTION

PATENT NO. : 7,036,242 B2
APPLICATION NO. : 10/415863
DATED : May 2, 2006
INVENTOR(S) : Antti Komulainen et al.

It is certified that error appears in the above-identified patent and that said Letters Patent is hereby corrected as shown below:

On the title page, item (56), under the heading *References Cited*, "Kokinen et al." should be --Jokinen et al.--

In column 20, line 6 of the issued patent, "1200" should be --120°--

In column 23, line 15 of the issued patent, "111" should be --11--

In column 26, line 23 of the issued patent, "111" should be --11--

Signed and Sealed this

Eighth Day of August, 2006

JON W. DUDAS
*Director of the United States Patent and Trademark Office*